US012372319B1

(12) United States Patent
Farmer et al.

(10) Patent No.: US 12,372,319 B1
(45) Date of Patent: Jul. 29, 2025

(54) FIRE CONTROL MECHANISM

(71) Applicant: Biofire Technologies Inc., Broomfield, CO (US)

(72) Inventors: Samuel James Farmer, Superior, CO (US); Benjamin William Dwyer, Golden, CO (US); Boramy Seang, Denver, CO (US); Samuel Jebsen, Superior, CO (US); Jack Hugo Thiesen, Firestone, CO (US); Katherine Joanne Lund, Westminster, CO (US); Joseph Ray Wilding, Castle Rock, CO (US)

(73) Assignee: Biofire Technologies Inc., Broomfield, CO (US)

( * ) Notice: Subject to any disclaimer, the term of this patent is extended or adjusted under 35 U.S.C. 154(b) by 0 days.

(21) Appl. No.: 18/619,856

(22) Filed: Mar. 28, 2024

Related U.S. Application Data

(60) Provisional application No. 63/493,107, filed on Mar. 30, 2023.

(51) Int. Cl.
*F41A 19/10* (2006.01)
*F41A 19/13* (2006.01)
*F41A 19/58* (2006.01)

(52) U.S. Cl.
CPC ..... *F41A 19/10* (2013.01); *F41A 19/13* (2013.01); *F41A 19/58* (2013.01)

(58) Field of Classification Search
CPC ..... F41A 19/10; F41A 19/13; F41A 19/58
See application file for complete search history.

(56) References Cited

U.S. PATENT DOCUMENTS

| | | | | |
|---|---|---|---|---|
| 4,727,670 | A * | 3/1988 | Krouse | F41A 19/58 42/84 |
| 10,900,732 | B2 * | 1/2021 | Galie | F41A 19/69 |
| 11,313,636 | B2 * | 4/2022 | Roessel | F41A 19/10 |
| 11,485,495 | B1 * | 11/2022 | Gyurek | B64D 1/04 |
| 11,898,814 | B2 * | 2/2024 | Alicea, Jr. | F41A 17/56 |
| 12,044,493 | B2 * | 7/2024 | Roessel | F41A 19/12 |
| 2009/0300961 | A1 * | 12/2009 | Ruhland | F41A 19/58 42/84 |

* cited by examiner

*Primary Examiner* — Michelle Clement
(74) *Attorney, Agent, or Firm* — Perkins Coie LLP; Andrew T. Pettit

(57) ABSTRACT

The present disclosure provides systems and techniques for a fire control mechanism that is implementable in a gun. The fire control mechanism is operable to cause projectiles to be fired by the gun. The gun may include a trigger, a barrel defining a bore axis, a firing component, and an actuator configured to i) obstruct the firing component while in a default position and ii) be displaced in a direction that is substantially perpendicular to the bore axis in response to movement of the trigger, where displacement in the direction that is substantially perpendicular to the bore axis causes the firing component to be released and results in the gun firing a projectile. The gun may include an energy store located below the barrel when the gun is in an upright position, and the actuator may be displaced based on the energy store.

22 Claims, 13 Drawing Sheets

100

201

800

900

1100

1200

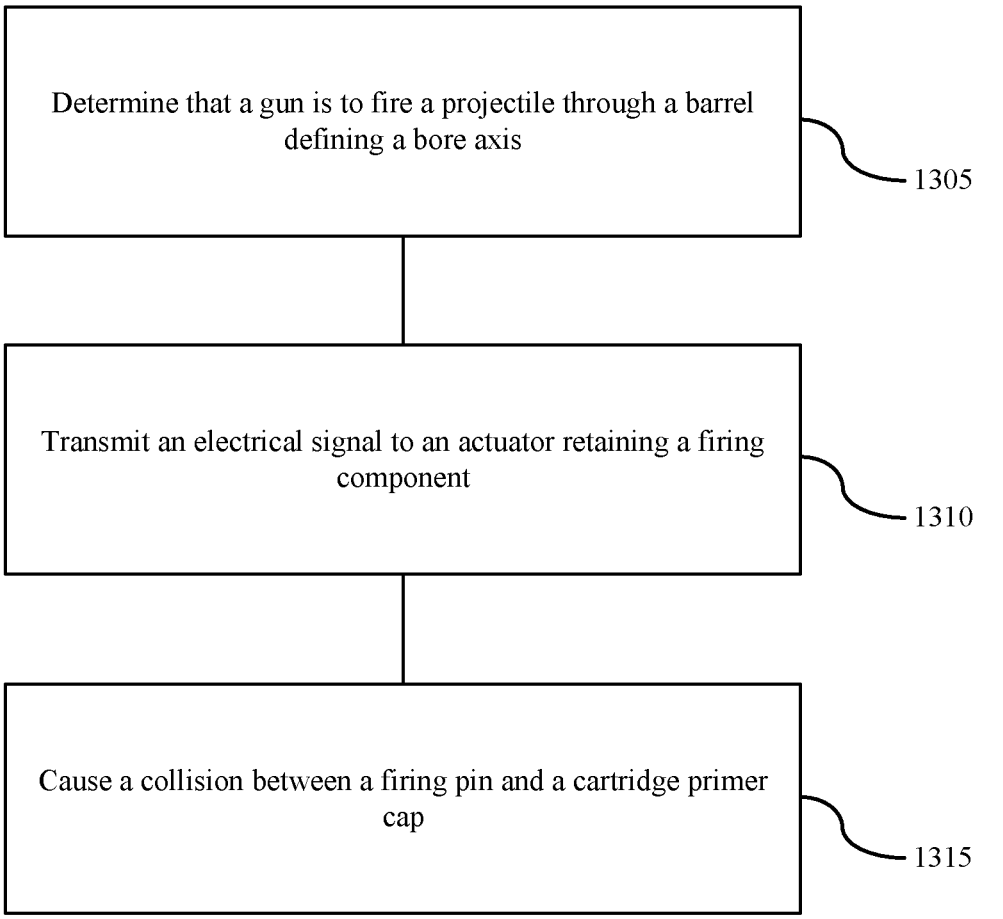
FIG. 13
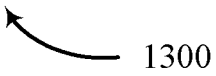

FIRE CONTROL MECHANISM

CROSS-REFERENCE TO RELATED APPLICATIONS

This application claims priority to U.S. Provisional Application No. 63/493,107, titled "Fire Control Mechanism" and filed on Mar. 30, 2023, which is incorporated by reference herein in its entirety.

FIELD OF TECHNOLOGY

The teachings disclosed herein generally relate to guns, and more specifically to fire control mechanisms that include an actuator.

BACKGROUND

The term "gun" generally refers to a ranged weapon that uses a shooting tube (also referred to as a "barrel") to launch solid projectiles, though some instead project pressurized liquid, gas, or even charged particles. These projectiles may be free flying (e.g., as with bullets), or these projectiles may be tethered to the gun (e.g., as with spearguns, harpoon guns, and electroshock weapons such as TASER® devices). The means of projectile propulsion vary according to the design (and thus, type of gun), but are traditionally effected pneumatically by a highly compressed gas contained within the barrel. This gas is normally produced through the rapid exothermic combustion of propellants (e.g., as with firearms) or mechanical compression (e.g., as with air guns). When introduced behind the projectile, the gas pushes and accelerates the projectile down the length of the barrel, imparting sufficient launch velocity to sustain it further towards a target after exiting the muzzle.

Most guns use compressed gas that is confined by the barrel to propel the projectile up to high speed, though the term "gun" may be used more broadly in relation to devices that operate in other ways. Accordingly, the term "gun" may not only cover handguns, shotguns, rifles, single-shot firearms, semi-automatic firearms, and automatic firearms, but also electroshock weapons, light-gas guns, plasma guns, and the like.

Significant energies have been spent developing safer ways to use, transport, store, and discard guns. Gun safety is an important aspect of avoiding unintentional injury due to mishaps like accidental discharges and malfunctions. Gun safety is also becoming an increasingly important aspect of designing and manufacturing guns. While there have been many attempts to make guns safer to use, transport, and store, those attempts have had little impact.

SUMMARY

The systems and techniques described herein support a fire control mechanism that includes an actuator and is implementable in a gun. The term "gun," as used herein, may be used to refer to a lethal force weapon, such as a pistol, a rifle, a shotgun, a semi-automatic firearm, or an automatic firearm; a less-lethal weapon, such as a stun-gun or a projectile emitting device; or an assembly of components operable to selectively discharge matter or charged particles, such as a firing mechanism.

Generally, the systems and techniques described herein provide for causing a gun to controllably fire a projectile. The gun may include a barrel defining a bore axis, a firing component, and an actuator configured to i) obstruct the firing component while in a default position and ii) be displaced in a direction that is substantially perpendicular to the bore axis in response to movement of the trigger.

BRIEF DESCRIPTION OF THE DRAWINGS

FIG. 13 illustrates an example of a flowchart showing a method of operating a gun with a trigger.

Figure 1:
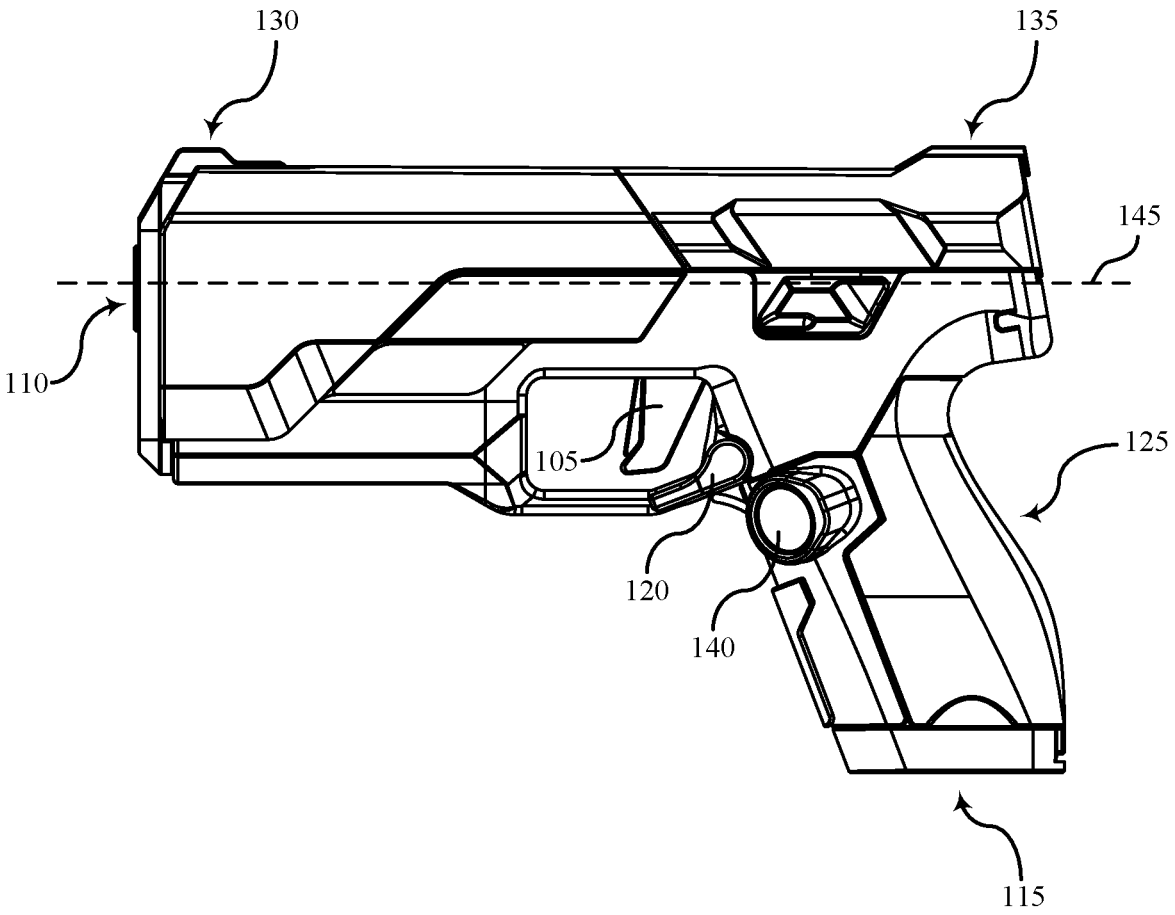
FIG. 1 illustrates an example of a gun including a fire control mechanism.

Various features of the technology described herein will become more apparent to those skilled in the art from a study of the Detailed Description in conjunction with the drawings. Various embodiments are depicted in the drawings for the purpose of illustration. However, those skilled in the art will recognize that alternative embodiments may be employed without departing from the principles of the technology. Accordingly, the technology is amenable to modifications that may not be reflected in the drawings.

DETAILED DESCRIPTION

In conventional guns, the sear is used to retain the striker, hammer, or bolt until the correct amount pressure has been applied to the trigger, at which point the striker, hammer, or bolt is released to fire the gun. For example, a conventional gun may utilize a sear with a first mechanical element (e.g., a bar) that is able to rest in a complementary structural feature (e.g., a notch) in a second mechanical element (e.g., a hammer or a striker). In operation, the first mechanical element holds the second mechanical element under tension, and when the trigger is pulled, the first mechanical element moves out of the complementary structural feature, releasing the second mechanical element such that the second mechanical element collides with a cartridge primer, ignites the propellant, and fires the gun.

Some conventional electromechanical guns include an inhibitor mechanism to attempt to deliver improved safety. But inhibition-based guns-namely, guns that engage an inhibitor mechanism to inhibit movement of a component (such as a trigger) while the gun is unarmed and disengage the inhibitor mechanism to arm the gun-utilize a holding current to either engage the inhibitor mechanism while the gun is unarmed or disengage the inhibitor mechanism while the gun is armed. In either case, the holding current may be present for hours or days at a time, thereby resulting in a significant drain on power and reducing the amount of time for which the gun can be used. Additionally, an inhibitor mechanism can often be defeated by simply removing the inhibitor from the gun. For example, an inhibition-based gun may include a bar that inhibits (or simply blocks) movement of the trigger while the gun is unarmed, and a holding current may be used to hold the bar in a different location such that the trigger is not inhibited by the bar so the gun can function as normal while the gun is armed. If a thief steals the gun and removes the inhibitor bar that is used to inhibit movement of the trigger, then the gun loses the safety benefits originally provided by the inhibitor mechanism.

Introduced here, therefore, is a fire control mechanism including an actuator that can be activated to cause the fire control mechanism to fire. The actuator may retain a firing component (e.g., a striker, a hammer, a bolt, or a sear) when in a default position, and activating the actuator may cause the firing component to be released, resulting in propulsion of a projectile away from the fire control mechanism. An actuator may be electronically activated, pneumatically activated, thermally activated, or the like. In some examples, an actuator may contact a firing component directly, while in some other examples, an actuator may control a cam mechanism that contacts a firing component. A fire control mechanism may include one or more actuators, which may be, for example, a linear actuator or a rotary actuator. Using an actuator to manage the sear in a fire control mechanism allows the trigger to not be mechanically coupled with the sear (or another firing component), thereby improving the safety of the fire control mechanism.

Embodiments may be described in the context of executable instructions for the purpose of illustration. For example, a fire control manager housed in a gun may be described as being capable of executing instructions that permit the firing of the gun in response to the trigger being pulled. However, those skilled in the art will recognize that aspects of the technology could be implemented via hardware, firmware, or software.

Terminology

References in the present disclosure to "an embodiment" or "some embodiments" means that the feature, function, structure, or characteristic being described is included in at least one embodiment. Occurrences of such phrases do not necessarily refer to the same embodiment, nor are they necessarily referring to alternative embodiments that are mutually exclusive of one another.

Unless the context clearly requires otherwise, the terms "comprise," "comprising," and "comprised of" are to be construed in an inclusive sense rather than an exclusive or exhaustive sense (i.e., in the sense of "including but not limited to"). The term "based on" is also to be construed in an inclusive sense rather than an exclusive or exhaustive sense. For example, the phrase "A is based on B" does not imply that "A" is based solely on "B." Thus, the term "based on" is intended to mean "based at least in part on" unless otherwise noted.

The terms "connected," "coupled," and variants thereof are intended to include any connection or coupling between two or more elements, either direct or indirect. The connection or coupling can be physical, electrical, logical, or a combination thereof. For example, elements may be electrically or communicatively coupled with one another despite not sharing a physical connection. As one illustrative example, a first component is considered coupled with a second component when there is a conductive path between the first component and the second component. As another illustrative example, a first component is considered coupled with a second component when the first component and the second component are fastened, joined, attached, tethered, bonded, or otherwise linked.

The term "manager" may refer broadly to software, firmware, or hardware. Managers are typically functional components that generate one or more outputs based on one or more inputs. A computer program may include or utilize one or more managers. For example, a computer program may utilize multiple managers that are responsible for completing different tasks, or a computer program may utilize a single manager that is responsible for completing all tasks. As another example, a manager may include an electrical circuit that produces an output based on hardware components, such as transistors, logic gates, analog components, or digital components. Unless otherwise noted, the terms "manager" and "module" may be used interchangeably herein.

When used in reference to a list of multiple items, the term "or" is intended to cover all of the following interpretations: any of the items in the list, all of the items in the list, and any combination of items in the list. For example, the list "A, B, or C" indicates the list "A" or "B" or "C" or "A and B" or "A and C" or "B and C" or "A and B and C."

Overview of Guns

FIG. 1 illustrates an example of a gun 100 including a fire control mechanism. The gun 100 includes a trigger 105, a barrel 110, a magazine 115, and a magazine release 120. While these components are generally found in firearms, such as pistols, rifles, and shotguns, those skilled in the art will recognize that the technology described herein may be similarly appliable to other types of guns as discussed above. As an example, comparable components may be included in vehicle-mounted weapons that are not intended to be held or operated by hand. While not shown in FIG. 1, the gun 100 may also include a striker (e.g., a ratcheting striker or rotating striker) or a hammer that can be actuated in response to pulling the trigger 105. Pulling the trigger 105 may result in the release of the striker or hammer, thereby causing the striker or hammer to contact a firing pin, percussion cap, or primer, so as to ignite a propellant and fire a projectile through the barrel 110. Embodiments of the gun 100 may also include a blowback system, a locked breech system, or any combination thereof. These systems are more commonly found in self-reloading firearms. The blowback system may be responsible for obtaining energy from the motion of the case of the projectile as it is pushed to the rear of the gun 100 by expanding propellant, while the locked breech system may be responsible for slowing down the opening of the breech of a self-reloading firearm when fired. Accordingly, the gun 100 may support the semi-automatic firing of projectiles, the automatic firing of projectiles, or both.

The gun 100 may include one or more safeties that are meant to reduce the likelihood of an accidental discharge or an unauthorized use. The gun 100 may include one or more mechanical safeties, such as a trigger safety or a firing pin safety. The trigger safety may be incorporated in the trigger 105 to prevent the trigger 105 from moving in response to lateral forces placed on the trigger 105 or dropping the gun. The term "lateral forces," as used herein, may refer to a force that is substantially orthogonal to a central axis 145 that extends along the barrel 110 from the front to the rear of the gun 100. The firing pin safety may block the displacement path of the firing pin until the trigger 105 is pulled. Additionally or alternatively, the gun 100 may include one or more electronic safety components, such as an electronically actuated drop safety. In some cases, the gun 100 may include both mechanical and electronic safeties to reduce the potential for an accidental discharge and enhance the overall safety of the gun 100.

The gun 100 may include one or more sensors, such as a user presence sensor 125 and a biometric sensor 140. In some cases, the gun 100 may include multiple user presence sensors 125 whose outputs can collectively be used to detect the presence of a user. For example, the gun 100 may include a time of flight (TOF) sensor, a photoelectric sensor, a capacitive sensor, an inductive sensor, a force sensor, a resistive sensor, or a mechanical switch. As another example, the gun 100 may include a proximity sensor that is configured to emit an electromagnetic field or electromagnetic radiation, like infrared, and looks for changes in the field or return signal. As another example, the gun 100 may include an inertial measurement unit (IMU) configured to identify a presence event in response to measuring movement that matches a movement signature of a user picking up the gun 100. As another example, the gun 100 may include an audio input mechanism (e.g., a transducer implemented in a microphone) that is configured to generate a signal that is representative of nearby sounds, and the presence of the user can be detected based on an analysis of the signal.

The gun 100 may also include one or more biometric sensors 140 as shown in FIG. 1. For example, the gun 100 may include a fingerprint scanner (also referred to as a "fingerprint scanner"), an image sensor, or an audio input mechanism. The fingerprint scanner may generate a digital image (or simply "image") of the fingerprint pattern of the user, and the fingerprint pattern can be examined (e.g., on the gun 100 or elsewhere) to determine whether the user should be verified. The image sensor may generate an image of an anatomical feature (e.g., the face or eye) of the user, and the image can be examined (e.g., on the gun 100 or elsewhere) to determine whether the user should be verified. Normally, the image sensor is a charge-coupled device (CCD) or complementary metal-oxide semiconductor (CMOS) sensor that is included in a camera module (or simply "camera") able to generate color images. The image sensor need not necessarily generate images in color, however. In some embodiments, the image sensor is configured to generate ultraviolet, infrared, or near infrared images. Regardless of its nature, images generated by the image sensor can be used to authenticate the presence or identity of the user. As an example, an image generated by a camera may be used to perform facial recognition of the user. The audio input mechanism may generate a signal that is representative of audio containing the voice of the user, and the signal can be examined (e.g., on the gun 100 or elsewhere) to determine whether the user should be verified. Thus, the signal generated by the audio input mechanism may be used to perform speaker recognition of the user. Including multiple biometric sensors in the gun 100 may support a robust authentication procedure that functions in the event of sensor failure, thereby improving gun reliability. Note, however, that each of the multiple biometric sensors may not provide the same degree or confidence of identity verification. As an example, the output produced by one biometric sensor (e.g., an audio input mechanism) may be used to determine whether a user is present while the output produced by another biometric sensor (e.g., a fingerprint scanner or image sensor) may be used to verify the identity of the user in response to a determination that the user is present.

The gun 100 may include one or more components that facilitate the collection and processing of token data. For example, the gun 100 may include an integrated circuit (also referred to as a "chip") that facilitates wireless communication. The chip may be capable of receiving a digital identifier, such as a Bluetooth® token or a Near Field Communication (NFC) identifier. The term "authentication data" may be used to describe data that is used to authenticate a user. For example, the gun 100 may collect authentication data from the user to determine that the user is authorized to operate the gun 100, and the gun 100 may be unlocked based on determining that the user is authorized to operate the gun 100. Authentication data may include biometric data, token data, or both. Authentication data may be referred to as enrollment data when used to enroll a user, and authentication data may be referred to as query data when used to authenticate a user. In some examples, the gun may transform (e.g., encrypt, hash, transform, encode, etc.) enrollment data and store the transformed enrollment data in memory (e.g., non-volatile memory) of the gun, and the gun may discard or refrain from storing query data in the memory. Thus, the gun 100 may transform authentication data, so as to inhibit unauthenticated use even in the event of unauthorized access of the gun.

The gun 100 may support various types of aiming sights (or simply "sights"). At a high level, a sight is an aiming device that may be used to assist in visually aligning the gun 100 (and, more specifically, its barrel 110) with a target. For example, the gun 100 may include iron sights that improve aim without the use of optics. Additionally or alternatively, the gun 100 may include telescopic sights, reflex sights, or laser sights. In FIG. 1, the gun 100 includes two sights-namely, a front sight 130 and a rear sight 135. In some cases, the front sight 130 or the rear sight 135 may be used to indicate gun state information. For example, the front sight 130 may include a single illuminant that is able to emit light of different colors to indicate different gun states. As another example, the front sight 130 may include multiple illuminants, each of which is able to emit light of a different color, that collectively are able to indicate different gun states. One example of an illuminant is a light-emitting diode (LED).

The gun 100 may fire projectiles, and the projectiles may be associated with lethal force or less-lethal force. For example, the gun 100 may fire projectiles containing lead, brass, copper, zinc, steel, plastic, rubber, synthetic polymers (e.g., nylon), or a combination thereof. In some examples, the gun 100 is configured to fire lethal bullets containing lead, while in other cases the gun 100 is configured to fire less-lethal bullets containing rubber. As mentioned above, the technology described herein may also be used in the context of a gun that fires prongs (also referred to as "darts") which are intended to contact or puncture the skin of a target and then carry electric current into the body of the target. These guns are commonly referred to as "electronic control weapons" or "electroshock weapons." One example of an electroshock weapon is a TASER device.

The gun 100 includes a fire control mechanism that is operable to cause projectiles to be propelled through the barrel 110. A fire control mechanism may include one or more actuators that can be activated to cause projectiles to be propelled away from the fire control mechanism. For example, the gun 100 may contain a fire control mechanism including an actuator that can be electronically activated to cause a bullet to be propelled through the barrel 110. The central axis 145 is an example of a bore axis defined through the center of the barrel 110, along the length of the barrel 110. The gun 100 includes a firing component and an actuator configured to i) obstruct the firing component while in a default position and ii) be displaced in a direction that is substantially perpendicular to the bore axis. A firing component is a component that can be displaced to cause the gun 100 to fire a projectile. Examples of a firing component include a striker, a hammer, a sear, a bolt, or a component that is mechanically coupled with a striker, hammer, sear, or bolt. Activating an actuator may cause a firing component to move, and movement of the firing component may result in the gun 100 firing a projectile. For example, moving a firing component from a first position to a second position may result in a firing pin colliding with a cartridge primer cap and a bullet being propelled through the barrel 110.

Figure 2:
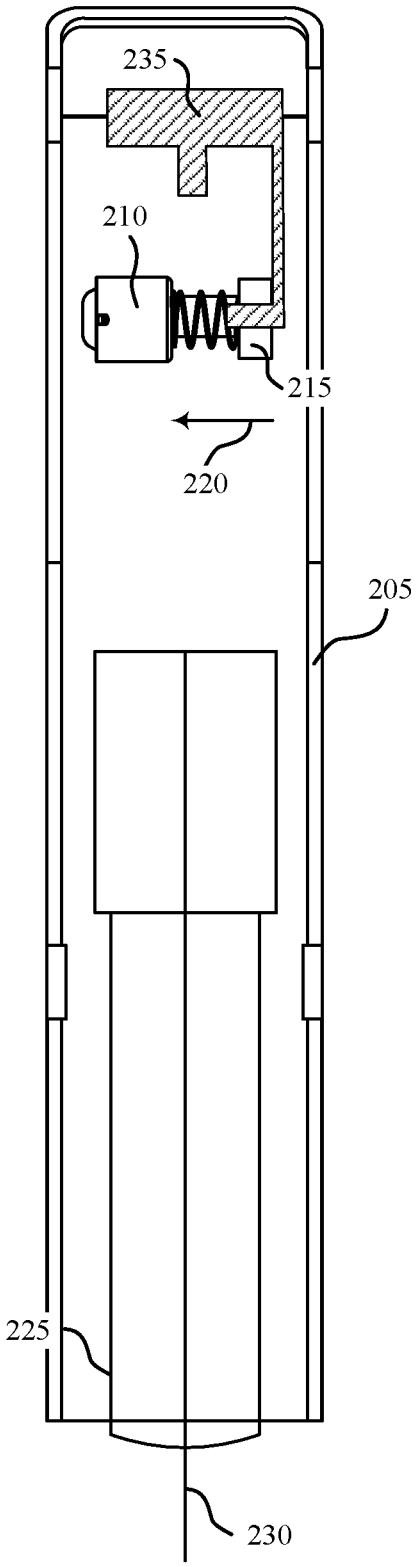
FIG. 2 illustrates an example of a fire control mechanism that is implementable in a gun.

FIG. 2 illustrates an example of a system 201 including a fire control mechanism. The fire control mechanism is housed within a frame 205, and the frame 205 may be an aspect of, or example of, a gun. The fire control mechanism includes an actuator 210 and a sear 235. The sear 235 is an example of a firing component, and the frame 205 may provide structure for the sear 235. Generally, as described herein, a frame provides structure for a firing component, such as a hammer, striker, sear, or bolt.

An actuator component 215 may be displaced in a direction that is substantially perpendicular to the bore axis 230 defined by the barrel 225. In other words, the actuator component 215 may be displaced along an axis that is substantially perpendicular to the bore axis 230. For example, to cause a projectile to be propelled through the barrel 225, the actuator 210 may be activated such that the actuator component 215 is displaced in the direction illustrated by the arrow 220, which may cause displacement of the sear 235 and result in the propulsion of a projectile through the barrel 225. As an example, the sear 235 may retain a striker, and activating the actuator 210 may cause the sear 235 to release the striker and ignite a cartridge propellant. As another example, the sear 235 may retain a hammer, and activating the actuator 210 may cause the sear 235 to release the hammer and ignite a cartridge propellant. Activating an actuator causes the actuator to be displaced, and it should be understood that displacing an actuator generally means that an aspect of the actuator, such as an actuator component, is displaced.

The actuator 210 may be activated electronically, pneumatically, hydraulically, magnetically, thermally, or the like. As an example, the actuator 210 may be an example of an electronic actuator containing a solenoid, a voice coil, or a piezoelectric element. As another example, the actuator 210 may be an example of a pneumatic actuator containing a chamber and a valve that controls the flow of gas. Unless stated otherwise, when a first axis is said to be "substantially" the same as a second axis, then the first axis and the second axis are of the same orientation within a threshold amount of difference, such as 30°. As an example, if an actuator is displaced in a direction that is substantially perpendicular to a first axis, then the direction moves along a second axis that forms 90° angle with the first axis, +/−30°. As another example, if two axes are said to be substantially parallel, then the angle between the two axes is no more than 30°.

Figure 3:
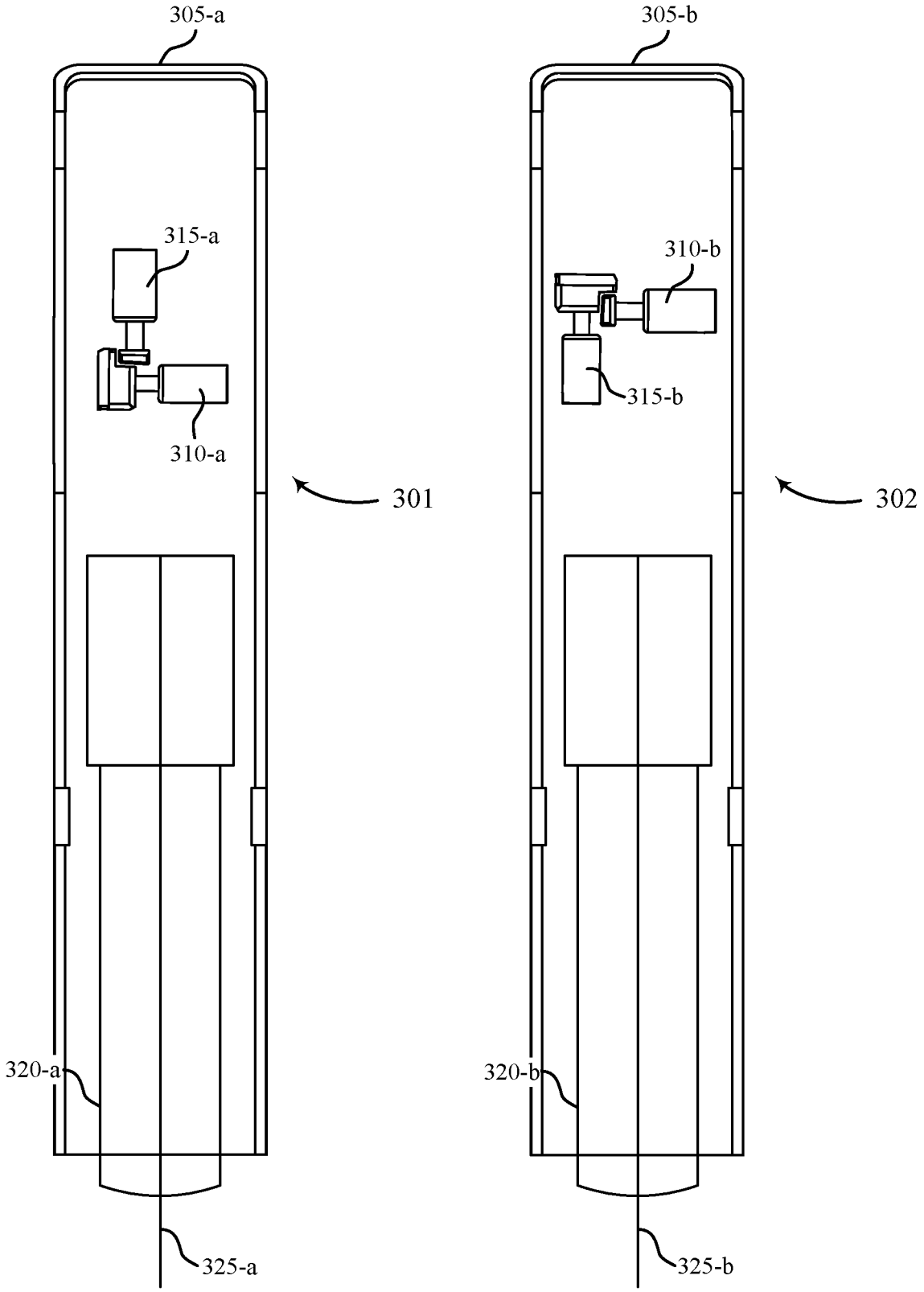
FIG. 3 illustrates examples of fire control mechanisms that include actuators configured in a perpendicular orientation.

FIG. 3 illustrates an example of a fire control mechanism 301 including perpendicular actuators and an example of a fire control mechanism 302 including perpendicular actuators.

The fire control mechanism 301 includes an actuator 310-*a* and an actuator 315-*a*. The actuator 310-*a* and the actuator 315-*a* are located in a frame 305-*a*, and the frame 305-*a* may be an aspect of, or an example of, a gun. The actuator 310-*a* and the actuator 315-*a* may be examples of linear actuators. The actuator 310-*a* and the actuator 315-*a* are configured to move in directions that are perpendicular to, or substantially perpendicular to, each other.

The gun includes a barrel 320-*a* defining a bore axis 325-*a*. The actuator 310-*a* may be positioned such that movement of the actuator 310-*a* is perpendicular to, or substantially perpendicular to, the bore axis 325-*a*. Activating the actuator 310-*a* and the actuator 315-*a* may cause a projectile to be propelled through the barrel 320-*a*. In other words, the gun including the frame 305-*a* may fire a projectile in response to activating both the actuator 310-*a* and the actuator 315-*a*. In some examples, the actuator 310-*a* may be activated after activating the actuator 315-*a*. For example, the gun including the frame 305-*a* may be fired in response to activating the actuator 310-*a* a predetermined amount of time after activating the actuator 315-*a*.

The fire control mechanism 302 includes an actuator 310-*b* and an actuator 315-*b*. The actuator 310-*b* and the actuator 315-*b* are located in a frame 305-*b*, and the frame 305-*b* may be an aspect of, or an example of, a gun. The actuator 310-*b* and the actuator 315-*b* may be examples of linear actuators. The actuator 310-*b* and the actuator 315-*b* are configured to move in directions that are perpendicular to, or substantially perpendicular to, each other.

The gun includes a barrel 320-*b* defining a bore axis 325-*b*. The actuator 310-*b* may be positioned such that movement of the actuator 310-*b* is perpendicular to, or substantially perpendicular to, the bore axis 325-*b*. Activating the actuator 310-*b* and the actuator 315-*b* may cause a projectile to be propelled through the barrel 320-*b*. In some examples, the actuator 315-*b* may be activated after activating the actuator 310-*b*. For example, the gun including the frame 305-*b* may be fired in response to activating the actuator 315-*b* a predetermined amount of time after activating the actuator 310-*b*.

Configuring two actuators to move along axes that are perpendicular to each other can improve the safety of the fire control mechanism, as any force that may create a temporarily vulnerability to the integrity of the actuator will have much less influence, if any influence, on the other actuator. Additionally, including an actuator that is perpendicular to a bore axis, such as the actuator 310-*a* or the actuator 310-*b*, can improve the safety of the fire control mechanism, as most of the recoil force will act on the actuator in a direction that is perpendicular to the direction in which the actuator is displaced.

Figure 4:
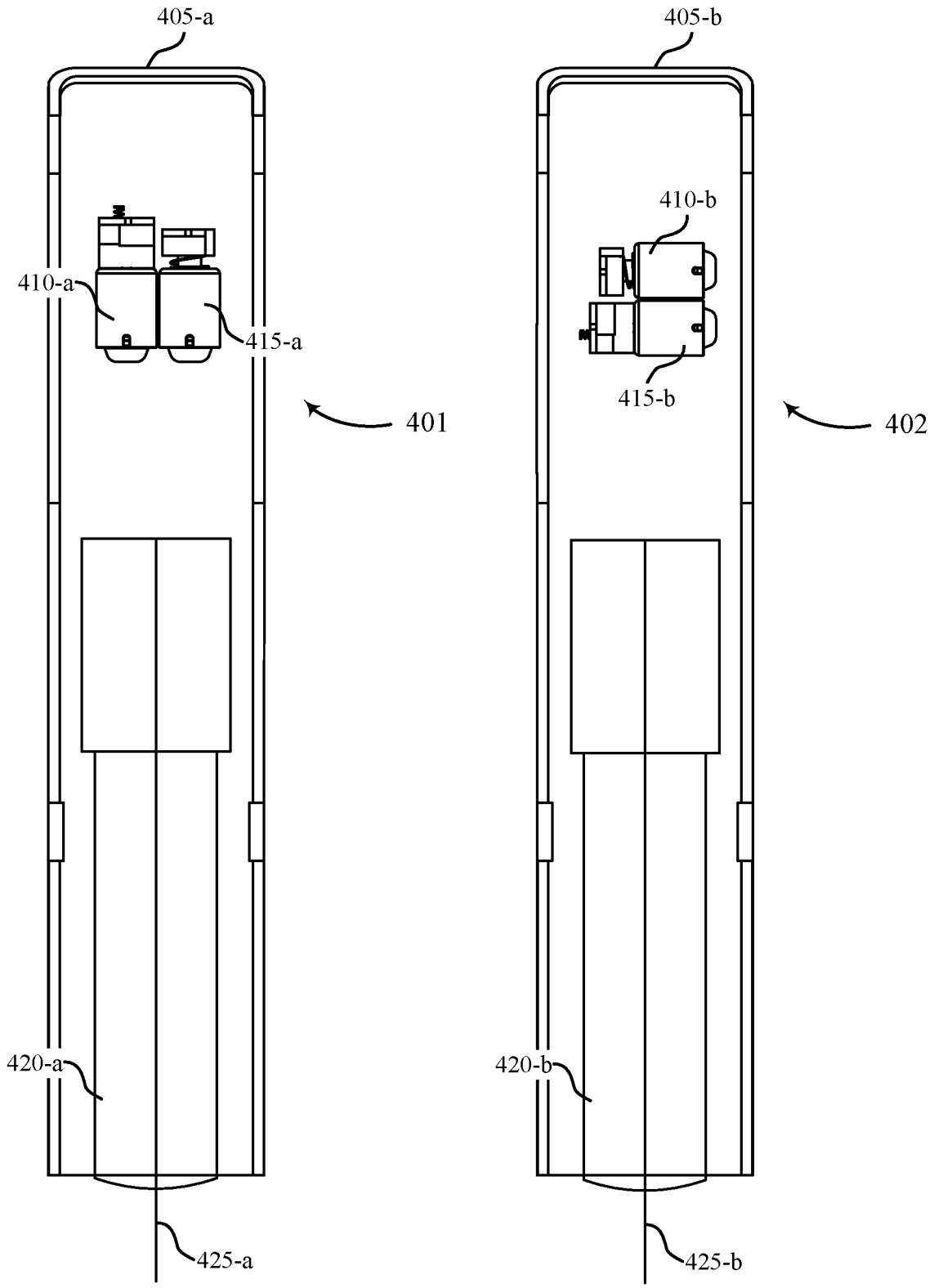
FIG. 4 illustrates examples of fire control mechanisms that include actuators configured in a parallel orientation.

FIG. 4 illustrates an example of a fire control mechanism 401 including parallel actuators and an example of a fire control mechanism 402 including parallel actuators.

The fire control mechanism 401 includes an actuator 410-*a* and an actuator 415-*a*. The actuator 410-*a* and the actuator 415-*a* are located in a frame 405-*a*, and the frame 405-*a* may be an aspect of, or an example of, a gun. The actuator 410-*a* and the actuator 415-*a* may be examples of linear actuators. The actuator 410-*a* and the actuator 415-*b* are configured to move in directions that are parallel to, or substantially parallel to, each other. In some examples, the actuator 410-*a* and the actuator 415-*b* are configured to be displaced in opposite directions that are parallel to the bore axis 425-*a* of the barrel 420-*a*.

The fire control mechanism 402 includes an actuator 410-*b* and an actuator 415-*b*. The actuator 410-*b* and the actuator 415-*b* are located in a frame 405-*b*, and the frame 405-*b* may be an aspect of, or an example of, a gun. The actuator 410-*b* and the actuator 415-*b* may be examples of linear actuators. The actuator 410-*b* and the actuator 415-*b* are configured to move in directions that are parallel to, or substantially parallel to, each other. In some examples, the actuator 410-*b* and the actuator 415-*b* are configured to be displaced in opposite directions that are perpendicular to the bore axis 425-*b* of the barrel 420-*b*.

Figure 5:
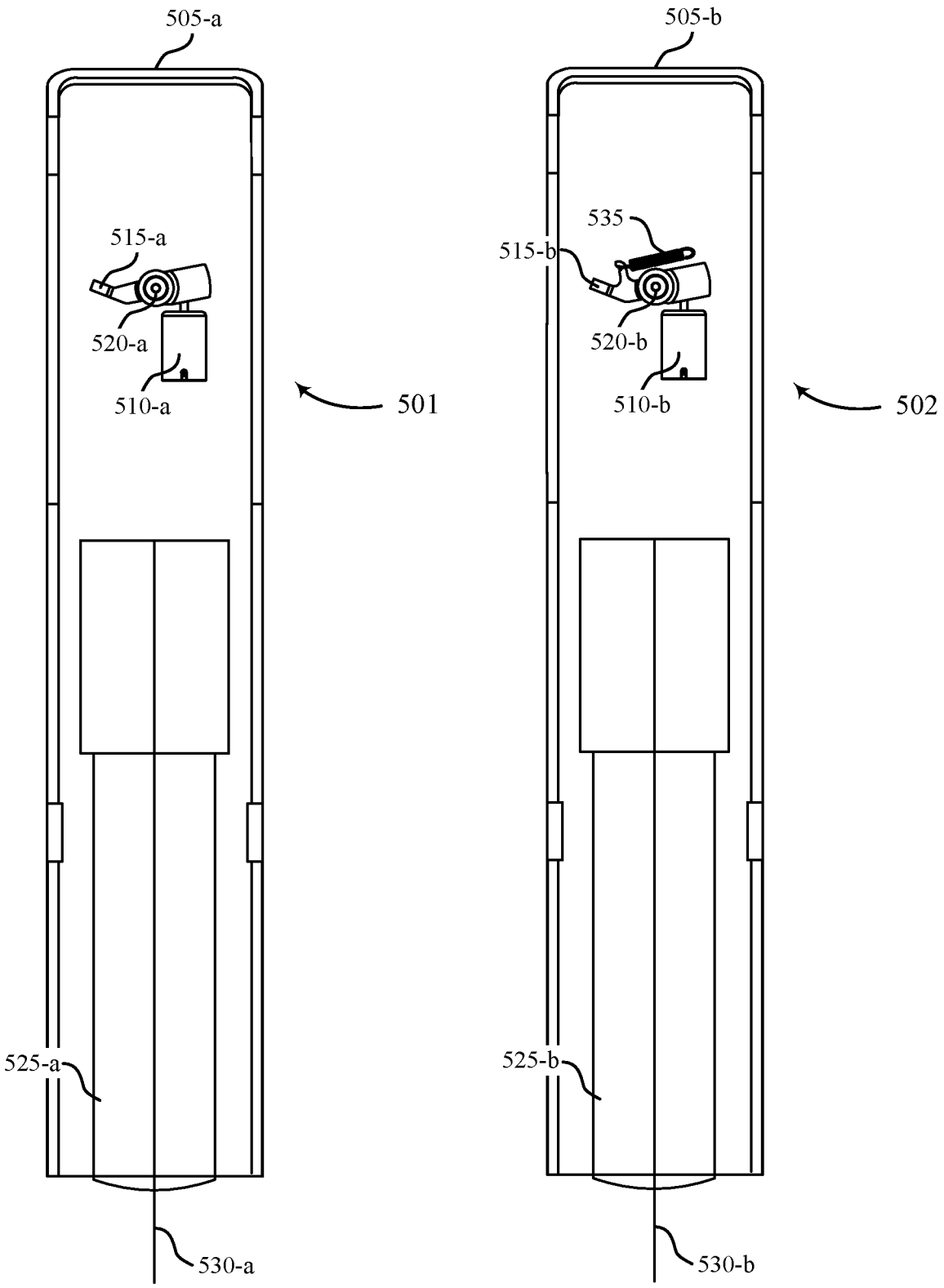
FIG. 5 illustrates examples of fire control mechanisms that include a rotary actuator.

FIG. 5 illustrates an example of a fire control mechanism 501 and an example of a fire control mechanism 502. FIG. 5 illustrates the fire control mechanism 501 in a frame 505-*a*, which provides structure to aspects of the fire control mechanism 501, such as the linear actuator 510-*a*. FIG. 5 illustrates the fire control mechanism 502 in a frame 505-*b*, which provides structure to aspects of the fire control mechanism 502, such as the linear actuator 510-*b*.

The fire control mechanism 501 includes a linear actuator 510-*a* that rotates an actuator component 515-*a* about an axis of rotation 520-*a*. The fire control mechanism 501 may propel a projectile through the barrel 525-*a* based on activating the linear actuator 510-*a*. For example, the actuator component 515-*a* may retain a firing component, such as a striker, a hammer, a sear, a bolt, a firing pin, or the like, and activating the linear actuator 510-*a* may cause the actuator component 515-*a* to rotate about the axis of rotation 520-*a* and release the firing component. The axis of rotation 520-*a* may be perpendicular to, or substantially perpendicular to, the bore axis 530-*a* of the barrel 525-*a*. The linear actuator 510-*a* may be configured to return to a default position after being activated. For example, a magnetic field may bias the actuator component 515-*a* in the default position such that actuator component 515-*a* retains the firing component. As another example, the linear actuator 510-*a* may be activated in a first direction to displace the actuator component 515-*a* such that the actuator component 515-*a* releases the firing component, and the linear actuator 510-*a* may be activated in a second direction to displace the actuator component 515-*a* such that the actuator component 515-*a* retains the firing component. The actuator component 515-*a* may obstruct the firing component while in the default position.

The fire control mechanism 502 includes a linear actuator 510-*b* that rotates an actuator component 515-*b* and a spring 535 that biases the actuator component 515-*b* in a default position. The actuator component 515-*b* may be configured to rotate about an axis of rotation 520-*b*. The fire control mechanism 502 may propel a projectile through the barrel 525-*b* based on activating the linear actuator 510-*b*. For example, the actuator component 515-*b* may retain a firing component, such as a striker, a hammer, a sear, or a bolt, and activating the linear actuator 510-*b* may cause the actuator component 515-*b* to rotate about the axis of rotation 520-*b* and release the firing component. The axis of rotation 520-*b* may be perpendicular to, or substantially perpendicular to, the bore axis 530-*b* of the barrel 525-*b*. The linear actuator 510-*b* may be configured to return to a default position after being activated. For example, the spring 535 may bias the actuator component 515-*b* in the default position such that the actuator component 515-*a* retains the firing component. The spring 535 is an example of a biasing device.

Displacing an actuator, or an aspect of an actuator, in an angular manner improves safety by reducing the likelihood of unintentional discharges. For example, angular displacement mitigates linear force vectors associated with dropping a gun, so utilizing an angular displacement path to cause a gun to fire reduces the likelihood of accidental discharges resulting from dropping the gun. As an example, an actuator component may rotate about an axis of rotation that is perpendicular to a bore axis of a barrel.

Figure 6:
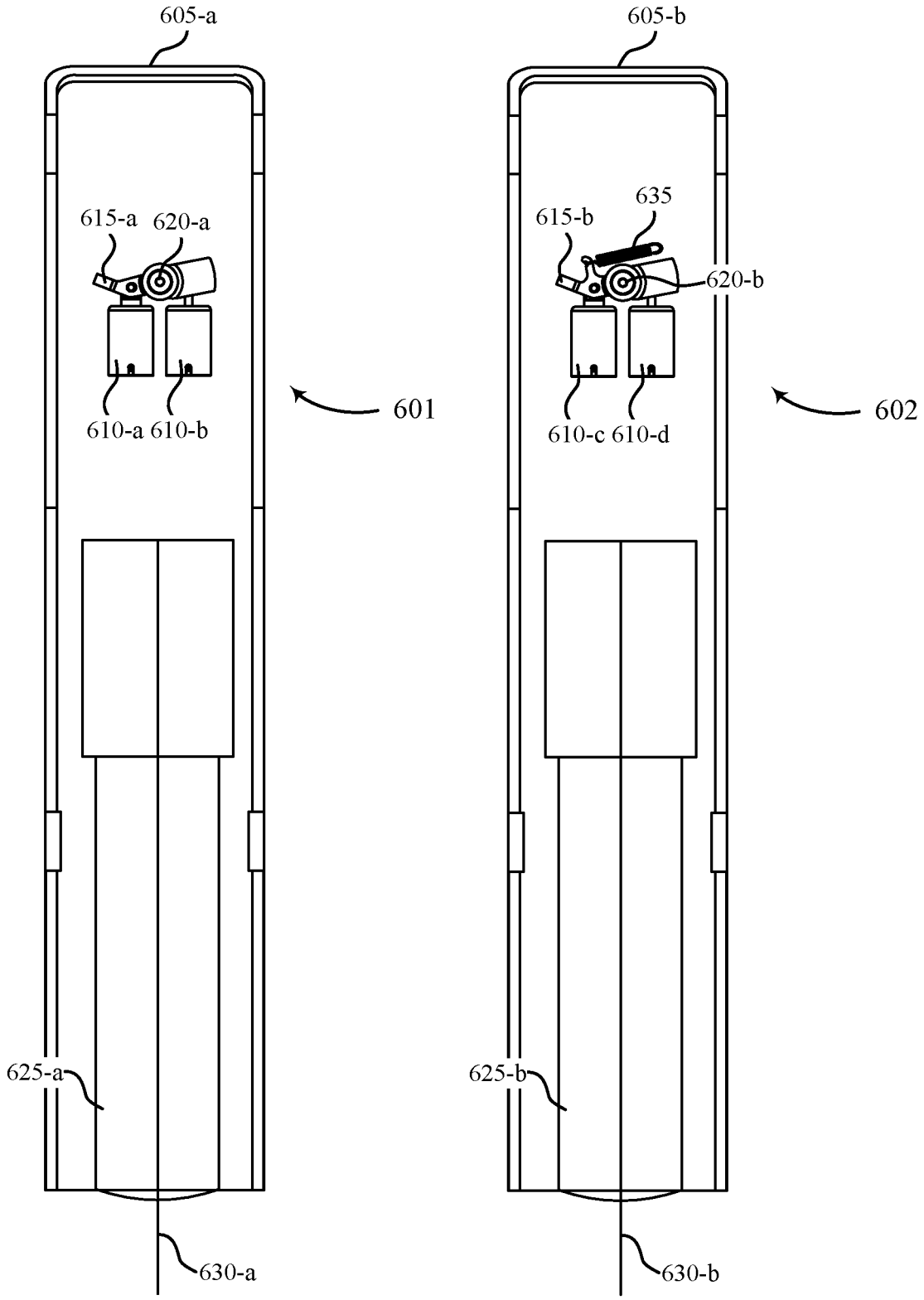
FIG. 6 illustrates examples of fire control mechanisms that include rotary actuators.

FIG. 6 illustrates an example of a fire control mechanism 601 and an example of a fire control mechanism 602.

The fire control mechanism 601 includes a linear actuator 610-*a* and a linear actuator 610-*b* that are configured to cause an actuator component 615-*a* to rotate about an axis of rotation 620-*a*. The linear actuator 610-*a* and the linear actuator 610-*b* may be coupled with the frame 605-*a*. The fire control mechanism 601 may propel a projectile through the barrel 625-*a* based on activating both the linear actuator 610-*a* and the linear actuator 610-*b*. The axis of rotation 620-*a* may be perpendicular to, or substantially perpendicular to, the bore axis 630-*a* of the barrel 625-*a*. In some examples, the actuator component 615-*a* may be biased in a default position based on a biasing device, while in some other examples, the linear actuator 610-*a* and the linear actuator 610-*b* may force the actuator component 615-*a* into the default position.

The fire control mechanism 602 includes a linear actuator 610-*c* and a linear actuator 610-*d* that are configured to cause an actuator component 615-*a* to rotate about an axis of rotation 620-*b*. The linear actuator 610-*c* and the linear actuator 610-*d* may be coupled with the frame 605-*b*. The fire control mechanism 602 may propel a projectile through the barrel 625-*b* based on activating both the linear actuator 610-*c* and the linear actuator 610-*d*. The axis of rotation 620-*b* may be perpendicular to, or substantially perpendicular to, the bore axis 630-*b* of the barrel 625-*b*. The spring 635 is an example of a biasing device that is configured to bias the actuator component 615-*b* in a default position.

Figure 7:
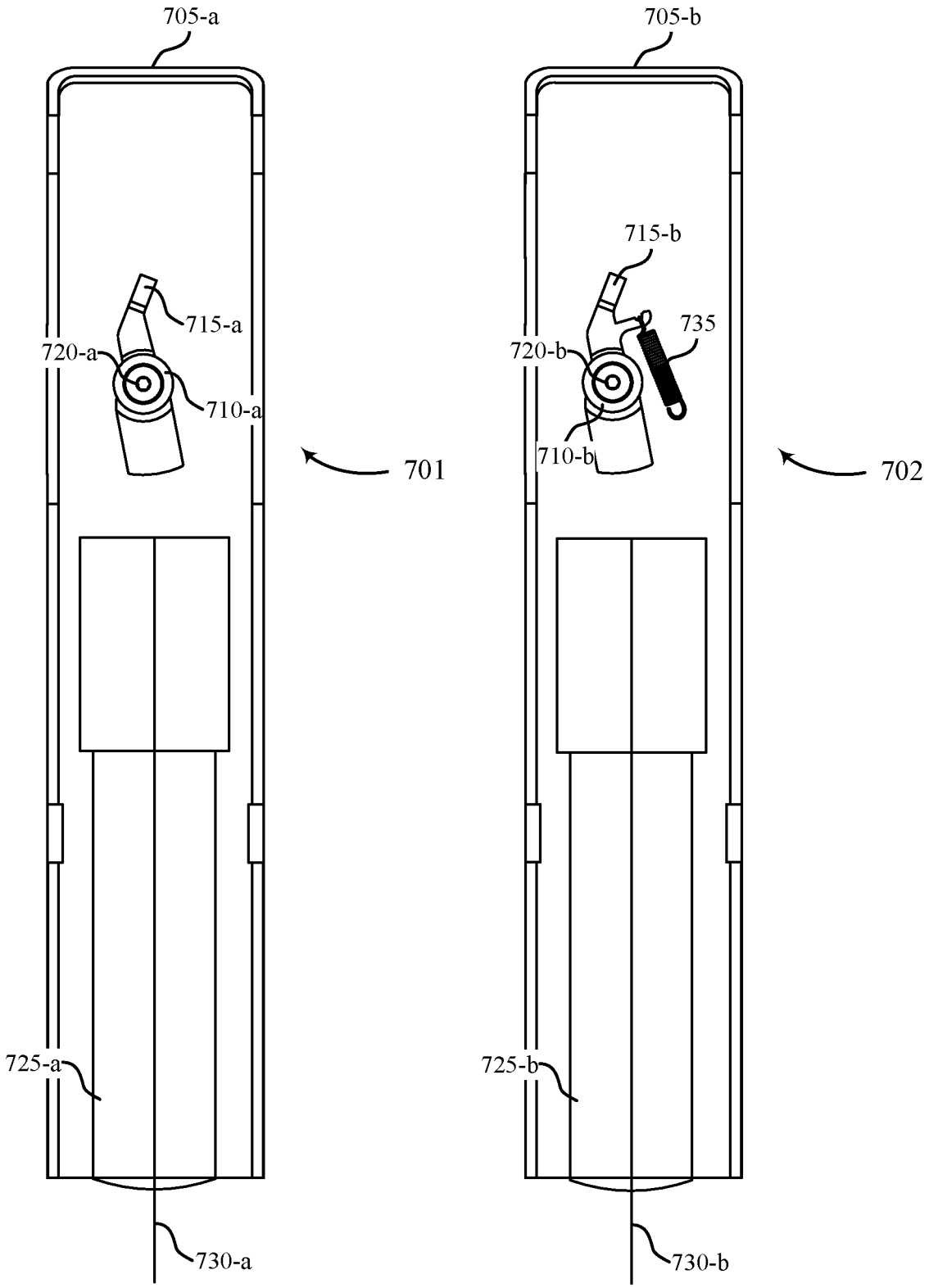
FIG. 7 illustrates examples of fire control mechanisms that include a rotary actuator.

FIG. 7 illustrates an example of a fire control mechanism 701 and an example of a fire control mechanism 702.

The fire control mechanism 701 includes a rotary actuator 710-*a* that rotates an actuator component 715-*a* about an axis of rotation 720-*a*. The rotary actuator 710-*a* may be coupled with the frame 705-*a*. The fire control mechanism 701 may propel a projectile through the barrel 725-*a* based on activating the rotary actuator 710-*a*. For example, the actuator component 715-*a* may retain a firing component, such as a striker, a hammer, a sear, a bolt, or the like, and activating the rotary actuator 710-*a* may cause the actuator component 715-*a* to rotate about the axis of rotation 720-*a* and release the firing component. The axis of rotation 720-*a* may be perpendicular to, or substantially perpendicular to, the bore axis 730-*a* of the barrel 725-*a*.

The fire control mechanism 702 includes a rotary actuator 710-*b* that rotates an actuator component 715-*b* about an axis of rotation 720-*b*. The rotary actuator 710-*b* may be coupled with the frame 705-*b*. The fire control mechanism 702 may propel a projectile through the barrel 725-*b* based on activating the rotary actuator 710-*b*. For example, the actuator component 715-*b* may retain a firing component, such as a striker, a hammer, a sear, a bolt, or the like, and activating the rotary actuator 710-*b* may cause the actuator component 715-*b* to rotate about the axis of rotation 720-*b* and release the firing component. The axis of rotation 720-*b* may be perpendicular to, or substantially perpendicular to, the bore axis 730-*b* of the barrel 725-*b*. The spring 735 is an example of a biasing device that is configured to bias the actuator component 715-*b* in a default position. In some examples, the actuator component 715-*b* may obstruct movement of a firing component while in a default position so as to prevent the fire control mechanism from firing when the actuator component 715-*b* is in the default position.

Figure 8:
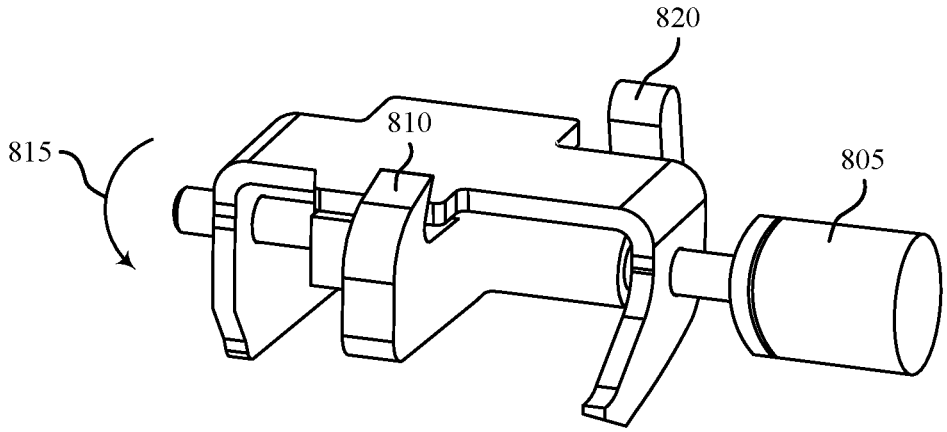
FIG. 8 illustrates an example of a fire control mechanism that includes a rotary actuator.

FIG. 8 illustrates an example of a fire control mechanism 800 that includes a rotary actuator 805.

The fire control mechanism 800 may be implemented in a gun. For example, the rotary actuator 805 may be affixed to a frame of a gun, and activating the rotary actuator 805 may cause the sear 810 to rotate in the direction of the arrow 815. As an example, the sear 810 may retain a firing component (e.g., a striker, a hammer, etc.) while in a default position, and activating the rotary actuator 805 may cause the sear 810 to be displaced, the firing component to be released, and the gun to fire. The fire control mechanism 800 may include a reset tab 820 that resets the sear 810 into the default position. For example, the gun slide may collide with the reset tab 820 during recoil and cause the sear 810 to be displaced into the default position.

Figure 9:
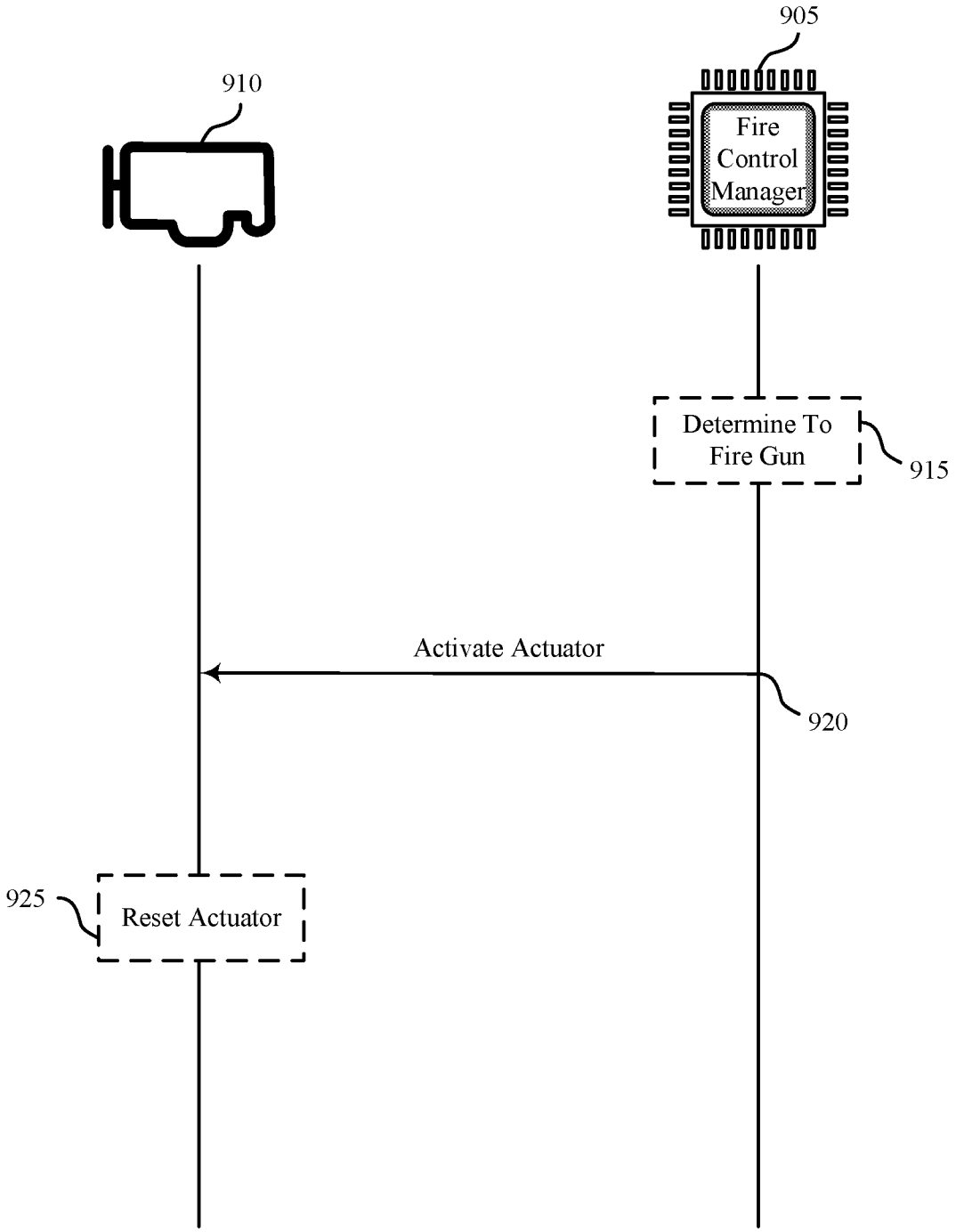
FIG. 9 illustrates an example of a process flow that supports controlling a fire control mechanism.

FIG. 9 illustrates an example of a process flow 900 that supports a fire control mechanism. The process flow 900 includes a fire control manager 905 and an actuator 910. Alternative examples of the following may be implemented, where some steps are performed in a different order than described or are not performed at all. In some cases, steps may include additional features not mentioned below, or further steps may be added.

The fire control manager 905 may be an aspect of a gun, and the fire control manager 905 may cause the gun to fire a projectile. For example, the fire control manager 905 may control a fire control mechanism including an actuator 910. The fire control manager 905 may include an electrical circuit that is capable of generating an electric pulse that results in activation of the actuator 910. The actuator 910 may, for example, be an electronic actuator, a pneumatic actuator, a hydraulic actuator, a thermal actuator, a piezoelectric actuator, or another type of actuator that causes displacement of an object.

At step 915, the fire control manager 905 may determine that the gun is to fire a projectile. The fire control manager 905 may determine to fire the gun in response to identifying a trigger break, detecting a user presence, authenticating a user, or any combination thereof. In some examples, the fire control manager 905 may determine to fire the gun based on a trigger sensor (e.g., a load cell, a mechanical switch, a photo-interrupt sensor, a Hall effect sensor, etc.) indicating a trigger break. A trigger break may be identified based on displacement of a detent or in response to trigger movement satisfying a displacement threshold, a force threshold, or both. The fire control manager 905 may be said to be monitoring for, and then identifying, "trigger breaks." Accordingly, the term "trigger break" may refer to a situation where the trigger moves from its default position in such a manner so as to indicate that the gun is to be fired.

At step 920, the fire control manager 905 may activate the actuator 910, and activating the actuator 910 may cause displacement of the actuator 910. The fire control manager 905 may activate the actuator 910 by transmitting an electrical signal, releasing pressurized gas, releasing fluid, or the like. Activating the actuator 910 may cause the gun to fire a projectile. For example, activating the actuator 910 may cause displacement of the actuator 910, or a component of the actuator 910, such that a firing component is released. Releasing a firing component may result in a collision between a firing pin and a cartridge primer cap, combustion of a cartridge propellant, and a bullet being accelerated through a barrel of the gun.

At step 925, the actuator 910 may be reset into a default position. The actuator 910 may retain and/or obstruct a firing component while in the default position. The actuator 910 may be reset based on a biasing device, such as a spring or a magnet. In some examples, the actuator 910 may be rest based on a gun slide directly or indirectly forcing the actuator 910 into the default position.

Figure 10:
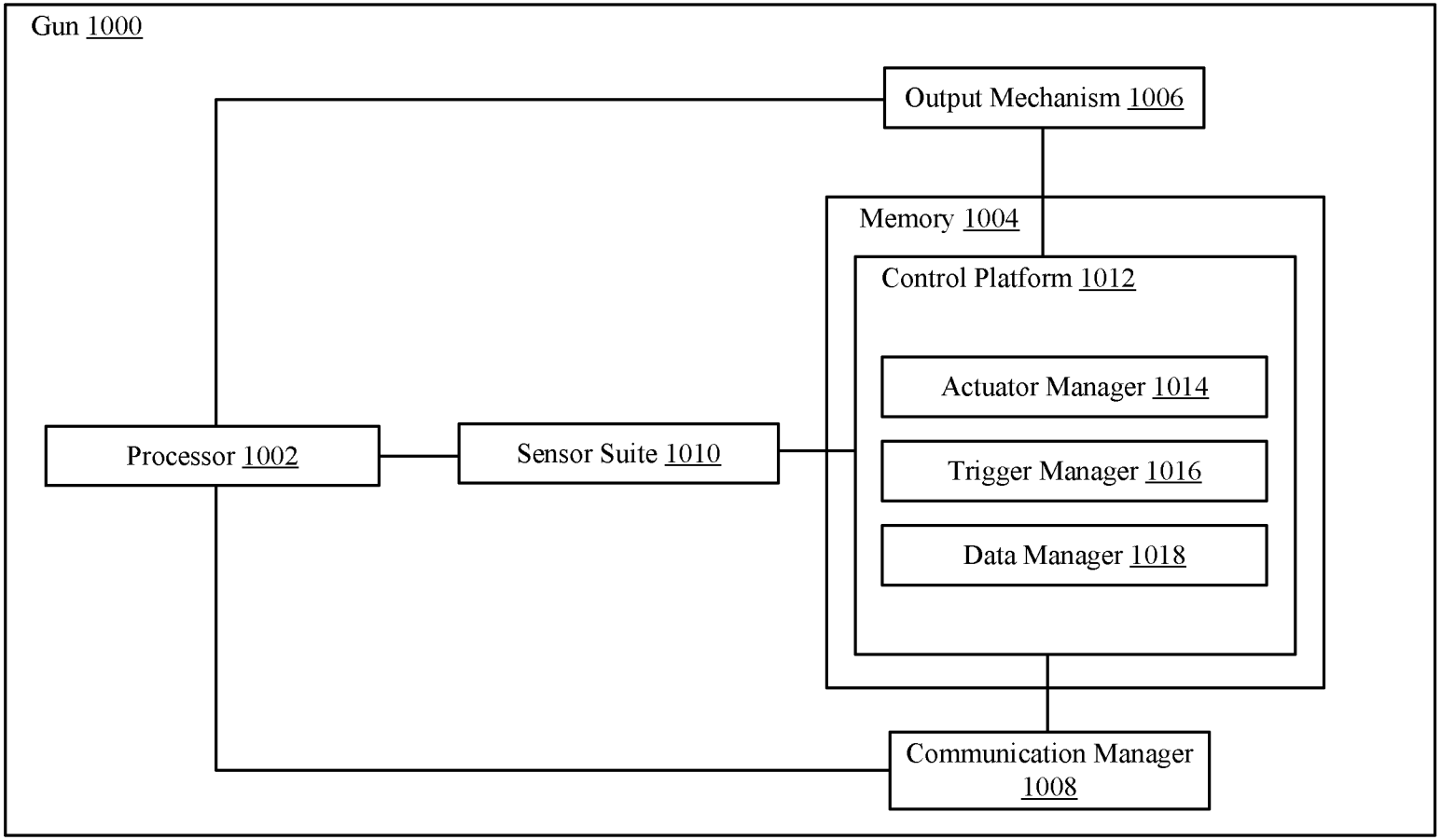
FIG. 10 illustrates an example of a gun that includes a fire control mechanism.

FIG. 10 illustrates an example of a gun 1000 able to implement a control platform 1012 designed to produce outputs that are helpful in ensuring the gun 1000 is used in an appropriate manner. As further discussed below, the control platform 1012 (also referred to as a "management platform" or a "fire control manager") may be designed to manage a fire control mechanism. For example, the control platform 1012 may cause the fire control mechanism to fire a round when the trigger is pulled, and the control platform 1012 may prevent the fire control mechanism from firing a round when the trigger is not pulled.

In some embodiments, the control platform 1012 is embodied as a computer program that is executed by the gun 1000. In other embodiments, the control platform 1012 is embodied as an electrical circuit that performs logical operations of the gun 1000. In yet other embodiments, the control platform 1012 is embodied as a computer program that is executed by a computing device to which the gun 1000 is communicatively connected. In such embodiments, the gun 1000 may transmit relevant information to the computing device for processing as further discussed below. Those skilled in the art will recognize that aspects of the computer program could also be distributed amongst the gun 1000 and computing device.

The gun 1000 can include a processor 1002, memory 1004, output mechanism 1006, and communication manager 1008. The processor 1002 can have generic characteristics similar to general-purpose processors, or the processor 1002 may be an application-specific integrated circuit (ASIC) that provides control functions to the gun 1000. As shown in FIG. 10, the processor 1002 can be coupled with all components of the gun 1000, either directly or indirectly, for communication purposes.

The memory 1004 may be comprised of any suitable type of storage medium, such as static random-access memory (SRAM), dynamic random-access memory (DRAM), electrically erasable programmable read-only memory (EEPROM), flash memory, or registers. In addition to storing instructions that can be executed by the processor 1002, the memory 1004 can also store data generated by the processor 1002 (e.g., when executing the managers of the control platform 1012). Note that the memory 1004 is merely an abstract representation of a storage environment. The memory 1004 could be comprised of actual memory chips or managers.

The output mechanism 1006 can be any component that is capable of conveying information to a user of the gun 1000. For example, the output mechanism 1006 may be a display panel (or simply "display") that includes LEDs, organic LEDs, liquid crystal elements, or electrophoretic elements. Alternatively, the display may simply be a series of illuminants (e.g., LEDs) that are able to indicate the status of the gun 1000. Thus, the display may indicate whether the gun 1000 is presently in a locked state, unlocked state, etc. As another example, the output mechanism 1006 may be a loudspeaker (or simply "speaker") that is able to audibly convey information to the user.

The communication manager 1008 may be responsible for managing communications between the components of the gun 1000. Additionally or alternatively, the communication manager 1008 may be responsible for managing communications with computing devices that are external to the gun 1000. Examples of computing devices include mobile phones, tablet computers, wearable electronic devices (e.g., fitness trackers), and network-accessible server systems comprised of computer servers. Accordingly, the communication manager 1008 may be wireless communication circuitry that is able to establish communication channels with computing devices. Examples of wireless communication circuitry include integrated circuits (also referred to as "chips") configured for Bluetooth, Wi-Fi®, NFC, and the like.

Sensors are normally implemented in the gun 1000. Collectively, these sensors may be referred to as the "sensor suite" 1010 of the gun 1000. For example, the gun 1000 may include a motion sensor whose output is indicative of motion of the gun 1000 as a whole. Examples of motion sensors include multi-axis accelerometers and gyroscopes. As another example, the gun 1000 may include a proximity sensor whose output is indicative of proximity of the gun 1000 to a nearest obstruction within the field of view of the proximity sensor. A proximity sensor may include, for example, an emitter that is able to emit infrared (IR) light and a detector that is able to detect reflected IR light that is returned toward the proximity sensor. These types of proximity sensors are sometimes called laser imaging, detection, and ranging (LiDAR) scanners. As another example, the gun 1000 may include a fingerprint sensor or camera that generates images which can be used for, for example, biometric authentication. As shown in FIG. 10, outputs produced by the sensor suite 1010 may be provided to the control platform 1012 for examination or analysis.

For convenience, the control platform 1012 may be referred to as a computer program that resides in the memory 1004. However, the control platform 1012 could be comprised of software, firmware, or hardware components that are implemented in, or accessible to, the gun 1000. In accordance with embodiments described herein, the control platform 1012 may include an actuator manager 1014, a trigger manager 1016, and a data manager 1018. As an illustrative example, the actuator manager 1014 may cause activation of an actuator, the trigger manager 1016 may process data generated by a trigger sensor, and the data manager 1018 may process data generated by a biometric sensor, such as a camera sensor or a fingerprint sensor. Because the data obtained by these managers may have different formats, structures, and content, the instructions executed by these managers can (and often will) be different. For example, the instructions executed by the trigger manager 1016 to process data generated by a trigger sensor may be different than the instructions generated by the data manager 1018 to process data generated by a camera. As a specific example, the data manager 1018 may implement image processing algorithms (e.g., for denoising, despeckling, etc.) that are not necessary for processing data generated by an accelerometer.

Figure 11:
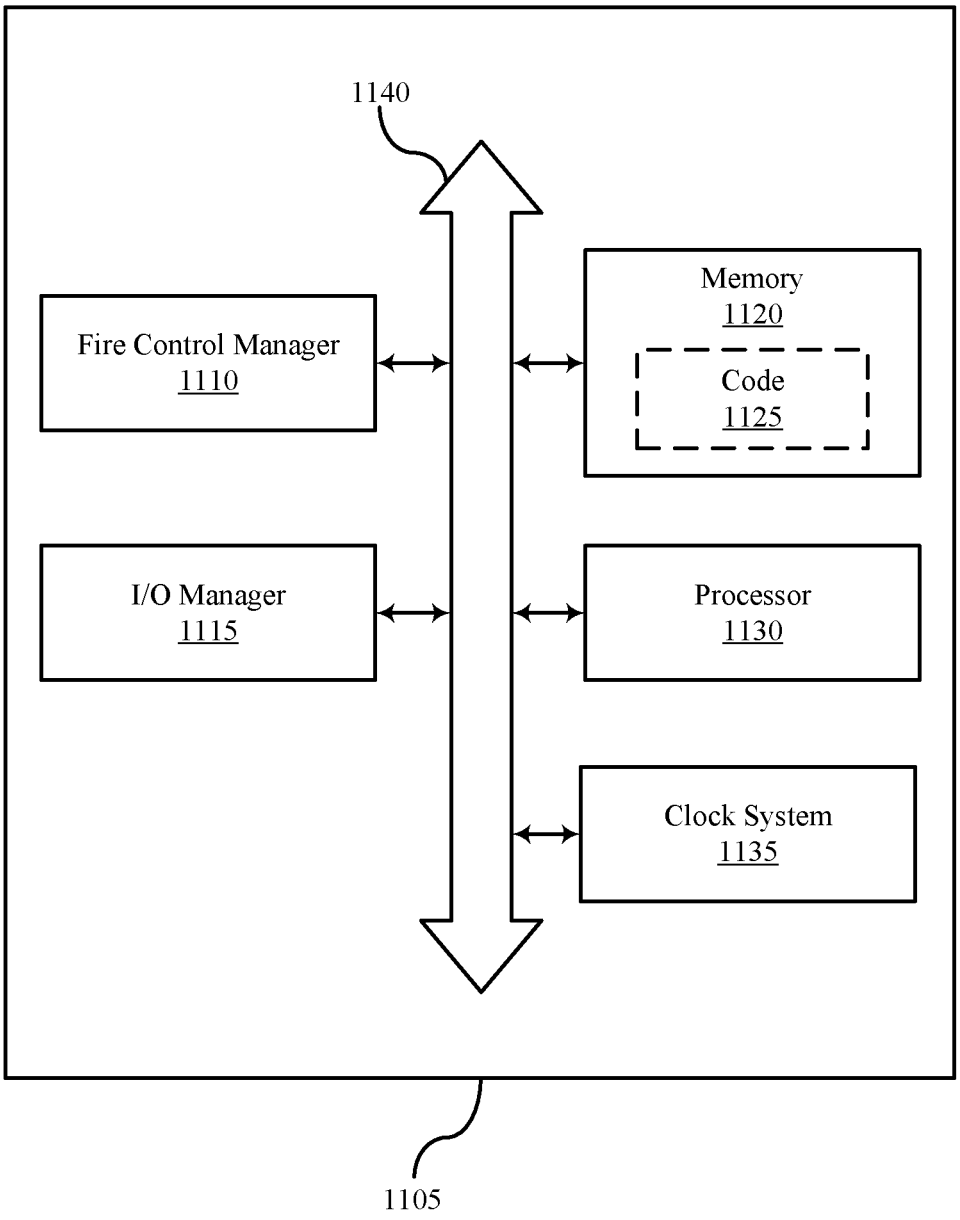
FIG. 11 illustrates an example of a system that includes a fire control manager that supports controlling a fire control mechanism.

FIG. 11 illustrates an example of a system 1100 that supports a fire control mechanism. The device 1105 may be operable to implement the techniques, technology, or systems disclosed herein. The device 1105 may include components such as a fire control manager 1110, an input/output (I/O) manager 1115, memory 1120, code 1125, a processor 1130, a clock system 1135, and a bus 1140. The components of the device 1105 may communicate via one or more buses 1140. The device 1105 may be an example of, or include components of, a firearm, a fire control mechanism, or a gun. A fire control mechanism may be operable to cause a projectile to be propelled from the fire control mechanism.

The fire control manager 1110 may determine, based on an analysis of movement of the trigger, that the device 1105 is to fire a projectile through a barrel defining a bore axis, transmit, in response to the determining that the device 1105 is to be fired, an electrical signal to an actuator retaining a firing component, where the transmitting the electrical signal causes the actuator to be displaced in a direction that is substantially perpendicular to the bore axis, and cause, based on the electrical signal, a collision between a firing pin and a cartridge primer cap, where the collision between the firing pin and the cartridge primer cap results in the projectile being fired through the barrel. The fire control manager 1110 may identify a trigger break based on a trigger sensor, where the transmitting the electrical signal to the actuator is in response to identifying the trigger break.

The I/O manager 1115 may manage input and output signals for the device 1105. The I/O manager 1115 may also manage various peripherals such an input device (e.g., a button, a switch, a touch screen, a dock, a biometric sensor, a pressure sensor, a heat sensor, a proximity sensor, an RFID sensor, etc.) and an output device (e.g., a monitor, a display, an LED, a speaker, a haptic motor, a heat pipe, etc.).

The memory 1120 may include or store code (e.g., software) 1125. The memory 1120 may include volatile memory, such as random-access memory (RAM) and/or non-volatile memory, such as read-only memory (ROM). The code 1125 may be computer-readable and computer-executable, and when executed, the code 1125 may cause the processor 1130 to perform various operations or functions described here.

The processor 1130 may be an example or component of a central processing unit (CPU), an application specific integrated circuit (ASIC), or a field programmable gate array (FPGA). In some embodiments, the processor 1130 may utilize an operating system or software such as Microsoft Windows®, iOS®, Android®, Linux®, Unix®, or the like. The clock system 1135 can control or maintain a timer for use by the disclosed embodiments.

The fire control manager 1110, or its sub-components, may be implemented in hardware, software (e.g., software or firmware) executed by a processor, or a combination thereof. The fire control manager 1110, or its sub-components, may be physically located in various positions. For example, in some cases, the fire control manager 1110, or its sub-components may be distributed such that portions of functions are implemented at different physical locations by one or more physical components.

Figure 12:
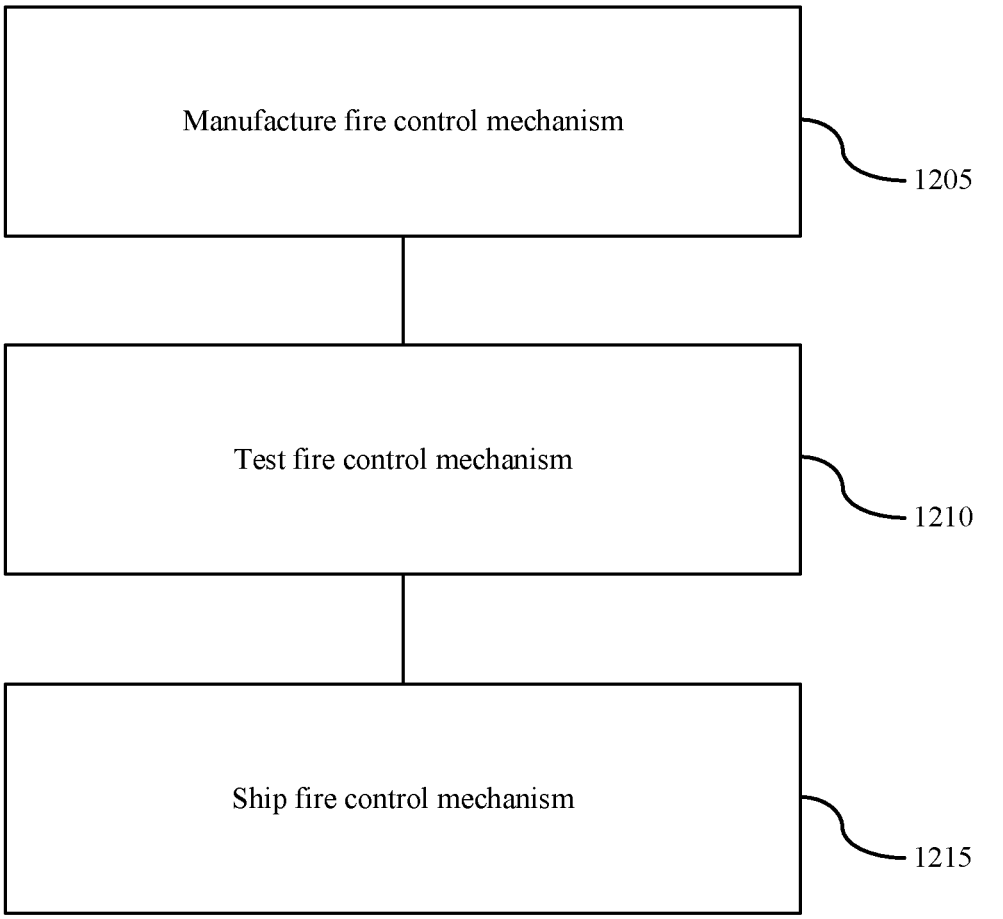
FIG. 12 illustrates an example of a flowchart showing a method of manufacturing a fire control mechanism.

FIG. 12 illustrates an example of a flowchart 1200 showing a method of manufacturing a fire control mechanism. Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

Initially, a manufacturer may manufacture a fire control mechanism that is able to implement aspects of the present disclosure (step 1205). The fire control mechanism may be an aspect of, or implementable in, a gun. For example, the manufacturer may machine, cut, shape, or otherwise make parts to be included in the fire control mechanism. Thus, the manufacturer may also design those parts before machining occurs, or the manufacturer may verify designs produced by another entity before machining occurs. Additionally or alternatively, the manufacturer may obtain parts that are manufactured by one or more other entities. Thus, the manufacturer may manufacture the fire control mechanism from components produced entirely by the manufacturer, components produced by other entities, or a combination thereof. Often, the manufacturer will obtain some parts and make other parts that are assembled together to form the fire control mechanism.

In some embodiments, the manufacturer also generates identifying information related to the fire control mechanism. For example, the manufacturer may etch (e.g., mechanically or chemically), engrave, or otherwise append identifying information onto the fire control mechanism itself. As another example, the manufacturer may encode at least some identifying information into a data structure that is associated with the fire control mechanism. For instance, the manufacturer may etch a serial number onto the fire control mechanism, and the manufacturer may also populate the serial number (and other identifying information) into a data structure for recording or tracking purposes. Examples of identifying information include the make of the fire control mechanism, the model of the fire control mechanism, the serial number, the type of projectiles used by the fire control mechanism, the caliber of those projectiles, and the like. In some cases, the manufacturer may record a limited amount of identifying information (e.g., only the make, model, and serial number), while in other cases the manufacturer may record a larger amount of identifying information.

The manufacturer may then test the fire control mechanism (step 1210). In some embodiments, the manufacturer tests all of the fire control mechanisms that are manufactured. In other embodiments, the manufacturer tests a subset of the fire control mechanisms that are manufactured. For example, the manufacturer may randomly or semi-randomly select fire control mechanisms for testing, or the manufacturer may select fire control mechanisms for testing in accordance with a predefined pattern (e.g., one test per 5 guns, 10 guns, or 100 guns). Moreover, the manufacturer may test the fire control mechanism in its entirety, or the manufacturer may test a subset of its components. For example, the manufacturer may test the component(s) that it manufactures. As another example, the manufacturer may test newly designed components or randomly selected components. Thus, the manufacturer could test select component (s) of the fire control mechanism, or the manufacturer could test the fire control mechanism as a whole. For example, the manufacturer may test the barrel to verify that it meets a precision threshold and the cartridge feed system to verify that it meets a reliability threshold. As another example, the manufacturer may test a group of fire control mechanisms (e.g., all fire control mechanisms manufactured during an interval of time, fire control mechanisms selected at random over an interval of time, etc.) to ensure that those fire control mechanisms fire at a sufficiently high pressure (e.g., 70,000 pounds per square inch (PSI)) to verify that a safety threshold is met.

Thereafter, the manufacturer may ship the fire control mechanism to a dealer (step 1215). In the event that the fire control mechanism is a firearm, or embedded in a firearm, the manufacturer may ship the firearm to a Federal Firearms Licensed (FFL) dealer. For example, a purchaser (also referred to as a "customer") may purchase the firearm through a digital channel or non-digital channel. Examples of digital channels include web browsers, mobile applications, and desktop applications, while examples of non-digital channels include ordering via the telephone and ordering via a physical storefront. In such a scenario, the firearm may be shipped to the FFL dealer so that the purchaser can obtain the firearm from the FFL dealer. The FFL dealer may be directly or indirectly associated with the manufacturer of the fire control mechanism. For example, the FFL dealer may be a representative of the manufacturer, or the FFL dealer may sell and distribute firearms on behalf of the manufacturer (and possibly other manufacturers).

Note that while the sequences of the steps performed in the processes described herein are exemplary, the steps can be performed in various sequences and combinations. For example, steps could be added to, or removed from, these processes. Similarly, steps could be replaced or reordered. As an example, the manufacturer may iteratively test components while manufacturing the fire control mechanism, and therefore perform multiple iterations of steps 1205 and 1210 either sequentially or simultaneously (e.g., one component may be tested while another component is added to the fire control mechanism). Thus, the descriptions of these processes are intended to be open ended.

FIG. 13 shows a flowchart illustrating a method 1300 of operating a gun with a trigger. The operations of the method 1300 may be implemented by a gun or its components as described herein. For example, the operations of the method 1300 may be performed by a fire control manager. In some examples, a gun may execute a set of instructions to control the functional elements of the to perform the described functions. Additionally or alternatively, the gun may perform aspects of the described functions using special-purpose hardware.

At step 1305, the gun may determine that the gun is to fire a projectile though a barrel defining a bore axis. In some examples, the gun may determine that the gun is to fire based on an analysis of movement of the trigger.

At step 1310, the gun may transmit an electrical signal to an actuator retaining a firing component. In some cases, the gun may transmit the electrical signal in response to the determining that the gun is to fire the projectile. For example, the gun may transmit the electrical signal in response to a trigger sensor (e.g., a Hall effect sensor, a pressure sensor, a mechanical switch, etc.) generating an output. The transmitting the electrical signal may cause the actuator to be displaced in a direction that is substantially perpendicular to the bore axis.

At step 1315, the gun may cause a collision between a firing pin and a cartridge primer cap. The collision between the firing pin and the cartridge primer cap may result in the projectile being fired through the barrel.

Note that while the sequences of the steps performed in the processes described herein are exemplary, the steps can be performed in various sequences and combinations. For example, steps could be added to, or removed from, these processes. Similarly, steps could be replaced or reordered. Thus, the descriptions of these processes are intended to be open ended.

EXAMPLES

Several aspects of the present disclosure are set forth examples. Note that, unless otherwise specified, all of these examples can be combined with one another. Accordingly, while a feature may be described in the context of a given example, the feature may be similarly applicable to other examples.

In some examples, the techniques described herein relate to a gun including a fire control mechanism capable of causing the gun to fire projectiles, the gun including: a barrel defining a bore axis; a firing component that is moveable between a first position and a second position; and an actuator that is configured to i) retain the firing component in the first position by default and ii) enable the firing component to move to the second position based on the actuator being displaced in a direction that is substantially perpendicular to the bore axis.

In some examples, the techniques described herein relate to a gun, further including: a firing pin that is configured to strike a cartridge primer cap in response to the firing component moving into the second position.

In some examples, the techniques described herein relate to a gun, further including: an energy store located below the barrel when the gun is in an upright position, wherein the actuator is displaced based on the energy store.

In some examples, the techniques described herein relate to a gun, further including: a biasing device configured to bias the actuator into a default position, wherein the actuator prevents the firing component from moving into the second position while in the default position.

In some examples, the techniques described herein relate to a gun, wherein the biasing device includes a coil spring.

In some examples, the techniques described herein relate to a gun, further including: a trigger that is movable to allow a user to controllably operate the gun, wherein the actuator is activated in response to movement of the trigger.

In some examples, the techniques described herein relate to a gun, wherein movement of the trigger does not mechanically translate to mechanical movement of the firing component.

In some examples, the techniques described herein relate to a gun, wherein the actuator includes an electronic actuator or a pneumatic actuator.

In some examples, the techniques described herein relate to a method of operating a gun with a trigger, the method including: determining, based on an analysis of movement of the trigger, that the gun is to fire a projectile through a barrel defining a bore axis; transmitting, in response to the determining that the gun is to be fired, an electrical signal to an actuator retaining a firing component, wherein the transmitting the electrical signal causes the actuator to be displaced in a direction that is substantially perpendicular to the bore axis; and causing, based on the electrical signal, a collision between a firing pin and a cartridge primer cap, wherein the collision between the firing pin and the cartridge primer cap results in the projectile being fired through the barrel.

In some examples, the techniques described herein relate to a method, further including: causing, based on a biasing device, the actuator to be displaced in an opposing direction that is opposite the direction.

In some examples, the techniques described herein relate to a method, further including: identifying a trigger break based on a trigger sensor, wherein the transmitting the electrical signal to the actuator is in response to the identifying the trigger break.

In some examples, the techniques described herein relate to a method, wherein the trigger sensor includes a load cell, a mechanical switch, a photo interrupter, or a Hall effect sensor.

In some examples, the techniques described herein relate to a method, further including: transmitting, in response to the determining that the gun is to be fired, an additional electrical signal to an additional actuator obstructing the actuator, wherein the transmitting the additional electrical signal causes the additional actuator to be displaced in an alternative direction that is different from the direction, wherein the causing the collision between the firing pin and the cartridge primer cap is further based on the additional electrical signal.

In some examples, the techniques described herein relate to a method, wherein the alterative direction is parallel to the direction, or wherein the alternative direction is perpendicular to the direction.

In some examples, the techniques described herein relate to a gun including a fire control mechanism capable of causing the gun to fire projectiles, the gun including: a barrel defining a bore axis; a firing component that is moveable between a first position and a second position; a cam configured to i) retain the firing component by default and ii) release the firing component in response to rotating about an axis of rotation; and an actuator coupled with the cam, wherein the cam is configured to rotate about the axis of rotation based on linear displacement of the actuator.

In some examples, the techniques described herein relate to a gun, wherein moving the firing component into the second position causes a firing pin to collide with a cartridge primer cap.

In some examples, the techniques described herein relate to a gun, further including: an energy store located below the barrel when the gun is in an upright position, wherein the actuator is displaced based on the energy store.

In some examples, the techniques described herein relate to a gun, further including: a cam biasing device configured to bias the cam into a default position, wherein the cam prevents the firing component from moving into the second position while in the default position.

In some examples, the techniques described herein relate to a gun, wherein the cam biasing device includes a spring.

In some examples, the techniques described herein relate to a gun, further including: an actuator biasing device configured to bias the actuator into a default position, wherein the actuator prevents the cam from rotating about the axis of rotation by default.

In some examples, the techniques described herein relate to a gun, further including: an additional actuator coupled with the cam, wherein the cam is configured to rotate about the axis of rotation further based on linear displacement of the additional actuator.

In some examples, the techniques described herein relate to a gun, further including: an actuator biasing device configured to bias the additional actuator into a default position, wherein the additional actuator further prevents the cam from rotating about the axis of rotation by default.

In some examples, the techniques described herein relate to a method of operating a gun with a trigger, the method including: transmitting an electrical signal to an actuator coupled with a cam, wherein the actuator is configured to control movement of the cam, wherein the cam is configured to retain a firing component by default, and wherein the transmitting the electrical signal results in: linear displacement of the actuator, angular rotation of the cam, the firing component directing a firing pin into a cartridge primer cap, and a projectile being fired by the gun.

In some examples, the techniques described herein relate to a gun including a fire control mechanism capable of causing the gun to fire projectiles, the gun including: a barrel defining a bore axis; a firing component that is moveable between a first position and a second position, wherein the firing component is configured to cause a collision between a firing pin and a cartridge primer cap based on moving into the second position; and an actuator that is configured to rotate about an axis of rotation.

In some examples, the techniques described herein relate to a gun, further including: a biasing device configured to bias the actuator into a default position.

In some examples, the techniques described herein relate to a gun, the gun is configured to fire a projectile through the barrel in response to the firing component moving from the first position into the second position.

In some examples, the techniques described herein relate to a gun, wherein rotating the actuator about the axis of rotation causes the firing component to move into the second position.

In some examples, the techniques described herein relate to a gun, wherein rotating the actuator about the axis of rotation allows the firing component to move into the second position.

In some examples, the techniques described herein relate to a gun, wherein the axis of rotation is perpendicular to the bore axis.

In some examples, the techniques described herein relate to a method of operating a gun with a trigger, the method including: transmitting an electrical signal to an actuator, wherein the transmitting the electrical signal causes the actuator to rotate about an axis of rotation; and causing a movement of a firing component based on the electrical signal, wherein the movement of the firing component results in a projectile being fired from the gun.

In some examples, an apparatus may include or otherwise support a fire control mechanism. An apparatus (e.g., a fire control mechanism or a gun) may include means for determining that the apparatus is to fire a projectile through a barrel defining a bore axis, means for transmitting an electrical signal to an actuator retaining a firing component, where the transmitting the electrical signal causes the actuator to be displaced in a direction that is substantially perpendicular to the bore axis, and means for causing, a collision between a firing pin and a cartridge primer cap, where the collision between the firing pin and the cartridge primer cap results in the projectile being fired through the barrel. In some examples, the means for determining that the apparatus is to fire a projectile is a trigger sensor for a fire control manager. In some examples, the means for transmitting the electrical signal is an electrical circuit, a capacitor, a bank of capacitors, a battery, or a fire control manager. In some examples, the means for causing the collision between the firing pin and the cartridge primer cap is an actuator, a firing component, or a breech.

In some examples, an apparatus may include or otherwise support a fire control mechanism. An apparatus (e.g., a fire control mechanism or a gun) may include means for retaining and controllably releasing a firing component. In some examples, releasing the firing component may result in the apparatus firing a projectile. In some examples, the means for retaining and controllably releasing the firing component is an actuator, such as a linear actuator or a rotary actuator.

In some examples, an apparatus may include or otherwise support a fire control mechanism. An apparatus (e.g., a fire control mechanism or a gun) may include means for transmitting an electrical signal to an actuator coupled with a cam, where the actuator is configured to control movement of the cam, where the cam is configured to retain a firing component by default, and wherein the transmitting the electrical signal results in linear displacement of the actuator, angular rotation of the cam, the firing component directing a firing pin into a cartridge primer cap, and a projectile being fired by the gun. In some examples, the means for transmitting an electrical signal is an electrical circuit, a capacitor, a bank of capacitors, a battery, or a fire control manager.

Remarks

The Detailed Description provided herein, in connection with the drawings, describes example configurations and does not represent all the examples that may be implemented or that are within the scope of the claims. The term "example" used herein means "serving as an illustration or instance," and not "a preferred example."

The functions described herein may be implemented with a controller. A controller may include a fire control manager, a special-purpose processor, a general-purpose processor, a digital signal processor (DSP), a CPU, a graphics processing unit (GPU), a microprocessor, a tensor processing unit (TPU), a neural processing unit (NPU), an image signal processor (ISP), a hardware security module (HSM), an ASIC, a programmable logic device (such as an FPGA), a state machine, a circuit (such as a circuit including discrete hardware components, analog components, or digital components), or any combination thereof. Some aspects of a controller may be programmable, while other aspects of a control may not be programmable. In some examples, a digital component of a controller may be programmable (such as a CPU), and in some other examples, an analog component of a controller may not be programmable (such as a differential amplifier).

In some cases, instructions or code for the functions described herein may be stored on or transmitted over a computer-readable medium, and components implementing the functions may be physically located at various locations. Computer-readable media includes both non-transitory computer storage media and communication media. A non-transitory storage medium may be any available medium that may be accessed by a computer or component. For example, non-transitory computer-readable media may include RAM, SRAM, DRAM, ROM, EEPROM, flash memory, magnetic storage devices, or any other non-transitory medium that may be used to carry and/or store program code means in the form of instructions and/or data structures. The instructions and/or data structures may be accessed by a special-purpose processor, a general-purpose processor, a manager, or a controller. A computer-readable media may include any combination of the above, and a compute component may include computer-readable media.

In the context of the specification, the term "left" means the left side of the gun when the gun is held in an upright position, where the term "upright position" generally refers to a scenario in which the gun is oriented as if in a high-ready position with the barrel roughly parallel to the ground. The term "right" means the right side of the gun when the gun is held in the upright position. The term "front" means the muzzle end (also referred to as the "distal end") of the gun, and the term "back" means the grip end (also referred to as the "proximal end") of the gun. The terms "top" and "bottom" mean the top and bottom of the gun as the gun is held in the upright position. The relative positioning terms such as "left," "right," "front," and "rear" are used to describe the relative position of components. The relative positioning terms are not intended to be limiting relative to a gravitational orientation, as the relative positioning terms are intended to be understood in relation to other components of the gun, in the context of the drawings, or in the context of the upright position described above.

The foregoing description of various embodiments of the claimed subject matter has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling those skilled in the relevant art to understand the claimed subject matter, the various embodiments, and the various modifications that are suited to the particular uses contemplated.

Although the Detailed Description describes certain embodiments and the best mode contemplated, the technology can be practiced in many ways no matter how detailed the Detailed Description appears. Embodiments may vary considerably in their implementation details, while still being encompassed by the specification. Particular terminology used when describing certain features or aspects of various embodiments should not be taken to imply that the terminology is being redefined herein to be restricted to any specific characteristics, features, or aspects of the technology with which that terminology is associated. In general, the terms used in the following claims should not be construed to limit the technology to the specific embodiments disclosed in the specification, unless those terms are explicitly defined herein. Accordingly, the actual scope of the technology encompasses not only the disclosed embodiments, but also all equivalent ways of practicing or implementing the embodiments.

The language used in the specification has been principally selected for readability and instructional purposes. It may not have been selected to delineate or circumscribe the subject matter. It is therefore intended that the scope of the technology be limited not by this Detailed Description, but rather by any claims that issue on an application based hereon. Accordingly, the disclosure of various embodiments is intended to be illustrative, but not limiting, of the scope of the technology as set forth in the following claims.

What is claimed is:

1. A gun including a fire control mechanism capable of causing the gun to fire projectiles, the gun comprising:

a barrel defining a bore axis;

a firing component that is moveable between a first position and a second position; and an actuator that is configured to i) retain the firing component in the first position by default and ii) enable the firing component to move to the second position based on the actuator being displaced in a direction that is substantially perpendicular to the bore axis.

2. The gun of claim 1, further comprising:

a firing pin that is configured to strike a cartridge primer cap in response to the firing component moving into the second position.

3. The gun of claim 1, further comprising:

an energy store located below the barrel when the gun is in an upright position, wherein the actuator is displaced based on the energy store.

4. The gun of claim 1, further comprising:

a biasing device configured to bias the actuator into a default position, wherein the actuator prevents the firing component from moving into the second position while in the default position.

5. The gun of claim 4, wherein the biasing device comprises a coil spring.

6. The gun of claim 1, further comprising:

a trigger that is movable to allow a user to controllably operate the gun, wherein the actuator is activated in response to movement of the trigger.

7. The gun of claim 6, wherein movement of the trigger does not mechanically translate to mechanical movement of the firing component.

8. The gun of claim 1, wherein the actuator comprises an electronic actuator or a pneumatic actuator.

9. A method of operating a gun with a trigger, the method comprising:

determining, based on an analysis of movement of the trigger, that the gun is to fire a projectile through a barrel defining a bore axis;

transmitting, in response to the determining that the gun is to be fired, an electrical signal to an actuator retaining a firing component, wherein the transmitting the electrical signal causes the actuator to be displaced in a direction that is substantially perpendicular to the bore axis; and causing, based on the electrical signal, a collision between a firing pin and a cartridge primer cap, wherein the collision between the firing pin and the cartridge primer cap results in the projectile being fired through the barrel.

10. The method of claim 9, further comprising:

causing, based on a biasing device, the actuator to be displaced in an opposing direction that is opposite the direction.

11. The method of claim 9, further comprising:

identifying a trigger break based on a trigger sensor, wherein the transmitting the electrical signal to the actuator is in response to the identifying the trigger break.

12. The method of claim 11, wherein the trigger sensor comprises a load cell, a mechanical switch, a photo interrupter, or a Hall effect sensor.

13. The method of claim 9, further comprising:

transmitting, in response to the determining that the gun is to be fired, an additional electrical signal to an additional actuator obstructing the actuator, wherein the transmitting the additional electrical signal causes the additional actuator to be displaced in an alternative direction that is different from the direction, wherein the causing the collision between the firing pin and the cartridge primer cap is further based on the additional electrical signal.

14. The method of claim 13, wherein the alternative direction is parallel to the direction, or wherein the alternative direction is perpendicular to the direction.

15. A gun including a fire control mechanism capable of causing the gun to fire projectiles, the gun comprising:

a barrel defining a bore axis;

a firing component that is moveable between a first position and a second position;

a cam configured to i) retain the firing component by default and ii) release the firing component in response to rotating about an axis of rotation; and an actuator coupled with the cam, wherein the cam is configured to rotate about the axis of rotation based on linear displacement of the actuator.

16. The gun of claim 15, wherein moving the firing component into the second position causes a firing pin to collide with a cartridge primer cap.

17. The gun of claim 15, further comprising:

an energy store located below the barrel when the gun is in an upright position, wherein the actuator is displaced based on the energy store.

18. The gun of claim 15, further comprising:

a cam biasing device configured to bias the cam into a default position, wherein the cam prevents the firing component from moving into the second position while in the default position.

19. The gun of claim 18, wherein the cam biasing device comprises a spring.

20. The gun of claim 15, further comprising:

an actuator biasing device configured to bias the actuator into a default position, wherein the actuator prevents the cam from rotating about the axis of rotation by default.

21. The gun of claim 15, further comprising:

an additional actuator coupled with the cam, wherein the cam is configured to rotate about the axis of rotation further based on linear displacement of the additional actuator.

22. The gun of claim 21, further comprising:

an actuator biasing device configured to bias the additional actuator into a default position, wherein the additional actuator further prevents the cam from rotating about the axis of rotation by default.

* * * * *